US011512439B2

(12) United States Patent
Cook et al.

(10) Patent No.: US 11,512,439 B2
(45) Date of Patent: Nov. 29, 2022

(54) SYSTEM AND METHOD FOR TRANSPORTING HEAVY, OVERSIZED LOADS OVER LEVEE

(71) Applicant: Mammoet USA South, Inc., Rosharon, TX (US)

(72) Inventors: Michael Cook, Angleton, TX (US); Piet Nooren, Angleton, TX (US)

(73) Assignee: Mammoet USA South, Inc., Rosharon, TX (US)

( * ) Notice: Subject to any disclaimer, the term of this patent is extended or adjusted under 35 U.S.C. 154(b) by 136 days.

(21) Appl. No.: 17/019,663

(22) Filed: Sep. 14, 2020

(65) Prior Publication Data

US 2021/0079603 A1 Mar. 18, 2021

Related U.S. Application Data

(60) Provisional application No. 62/900,301, filed on Sep. 13, 2019.

(51) Int. Cl.
*E01D 15/12* (2006.01)

(52) U.S. Cl.
CPC ..... *E01D 15/124* (2013.01)

(58) Field of Classification Search
CPC ..... E01D 15/124
USPC ..... 14/73–77.1, 2.4
See application file for complete search history.

(56) References Cited

U.S. PATENT DOCUMENTS 2,024,001 A 12/1935 Hamilton
3,301,146 A 1/1967 Krug et al.
3,394,419 A 7/1968 Sedlacek
3,411,167 A 11/1968 Sedlacek
3,492,683 A 2/1970 Wagner et al.
(Continued)

FOREIGN PATENT DOCUMENTS

GB 553374 5/1943

OTHER PUBLICATIONS

BAE Systems "Bridging Capability," undated, obtained from www.baesystems.com, generated Sep. 14, 2020, 1-pg.
(Continued)

*Primary Examiner* — Raymond W Addie
(74) *Attorney, Agent, or Firm* — Cabello Hall Zinda, PLLC

(57) ABSTRACT

A system and method transports a load across an expanse between first and second locations. The first and second locations can be on land and/or water and having a base surface of ground, waterbed, and/or vessel between them. The system includes supports, ramps, and a bridge assembly. The supports mounting on the base surface and are disposed on first and second sides of the expanse. The ramps mount on adjacent ones of the supports and/or on at least one the supports and the base surface. The bridge assembly has one or more longitudinal girders configured to extend parallel to one another across the expanse. Each girder has beams being modular and being hingedly connected end-to-end. Each girder has a first end supported on a first support, has a second end supported on a second support, and has an entire length between the ends that is self-supported. The entire self-supported length supports and transfers weight of the load to the ends supported on the supports. In this way, weight from the load is not transferred to a levee or the like in the expanse.

20 Claims, 17 Drawing Sheets

(56) References Cited

U.S. PATENT DOCUMENTS 3,504,389 A * 4/1970 Eric ..... E01D 15/133 14/27
3,925,840 A 12/1975 Wagner
4,742,591 A * 5/1988 Muller ..... E01D 11/04 14/73.1
4,912,795 A 4/1990 Johnson
RE34,103 E 10/1992 Mabey et al.
5,173,981 A * 12/1992 Hasselkvist ..... E01D 15/133 14/2.4
5,870,789 A * 2/1999 Carranza-Aubry ..... E01D 2/04 405/285
6,539,571 B1 4/2003 Forsyth
6,804,927 B2 10/2004 Forsyth et al.
7,069,614 B1 * 7/2006 Sivachenko ..... E01D 2/00 52/579
8,020,235 B2 * 9/2011 Grace ..... E01D 2/02 14/78
8,220,095 B2 * 7/2012 Schultz ..... E01C 1/00 14/74
8,671,490 B1 * 3/2014 Carney ..... B66C 13/04 14/2.4
9,834,263 B1 12/2017 Nooren
2007/0180634 A1 * 8/2007 Grace ..... E01D 21/00 14/73
2009/0282625 A1 * 11/2009 Homsi ..... E01D 2/02 14/77.1
2014/0090190 A1 * 4/2014 McCloskey ..... B65G 69/30 14/69.5

OTHER PUBLICATIONS

BAE Systems, "Modular Bridging system," undated, obtained from www.baesystems.com, generated Sep. 14, 2020, 10-pgs.
BAE Systems, "New military bridges will give greater flexibility and increased reliability," obtained from www.baesystems.com, dated May 9, 2017, 5-pgs.
Mammoet, "Factory on the Move," Mammoet World, Issue 13, dated 2014, 4-pgs.
Federal Highway Administration, "Historical Background of Steel Bridges—Prefabricated Steel Bridge Systems: Final Report," obtained from www.fhwa.dot.gov, updated Jul. 26, 2018, 31-pgs.

* cited by examiner

SYSTEM AND METHOD FOR TRANSPORTING HEAVY, OVERSIZED LOADS OVER LEVEE

CROSS-REFERENCE TO RELATED APPLICATIONS

This application claims the benefit of U.S. Prov. Appl. No. 62/900,301, filed 13, Sep. 2019, which is incorporated herein by reference in its entirety.

FIELD OF THE DISCLOSURE

The present disclosure relates generally to systems and methods for transporting a heavy, over-sized load and more particularly relates to a modular assembly of girders, ramps, supports, and transporters for transporting a heavy, over-sized load over an expanse having an obstruction, such as a levee, which should not be subject to the weight of the load.

BACKGROUND OF THE DISCLOSURE

Bridges can be built using interconnected components. In fact, such bridges have been used in road construction and in military systems for some time. As one example, U.S. Pat. No. 3,411,167 discloses a road construction that can be assembled and disassembled on vertical supports. The roadway includes a plurality of identical vehicle supporting elements, each consisting of two longitudinal main girder members, a plurality of rectangular roadway plates having their narrow edges extending parallel to the main girder members and rigidly connected thereto, and angle irons defining curbs extending parallel to the narrow edges of the roadway plates and fastened to the main girder members. The elements are connectible together by hinge portions that permit adjacent elements to be vertically pivoted relative to one another, and by fasteners that permit adjacent elements to be connected together with any desired horizontal and vertical angular orientation with respect to each other.

Although such modular constructions are known, they have limited use in transporting very heavy and large loads weighing thousands of tons. As will be appreciated, transporting such very heavy and large loads can be significantly challenging. These types of loads may be transported on a barge to a destination. For example, a modular unit for a refinery may be transported from one location to another by moving the unit down a waterway on the barge and then moving the unit from the barge to the refinery on land.

In many instances, transporting the heavy and large load requires moving the load from the barge or like to the destination over an area lacking a suitable base surface, having natural obstructions, having man-made obstructions, or other obstacles, which makes moving the load difficult. In fact, it is not uncommon that levees are used near waterways, making transport difficult from the waterway to a destination on the other side of the levee.

Building up infrastructure, berms, pads, and the like to transport the heavy load over the levee can be expensive and time consuming. Moreover, the levee and any surrounding base surface may not allow for significant modifications or alterations to be made. The integrity of the levee must be maintained to the satisfaction of the Federal Authorities.

The subject matter of the present disclosure is directed to overcoming, or at least reducing the effects of, one or more of the problems set forth above.

SUMMARY OF THE DISCLOSURE

An assembly disclosed herein is used for transporting a load across an expanse between first and second supports.

For example, the load can be a heavy, over-sized load, such as a modular unit or a pipe rack module for a refinery. The expanse may have a levee between a waterway on one side and a refinery on the other side.

The assembly comprises one or more longitudinal girders configured to extend parallel to one another across the expanse. Each of the one or more longitudinal girders comprises at least two beams being modular and being hingedly connected end-to-end. Each of the one or more longitudinal girders comprises a first end, a second end, and a length between the first and second ends. The first end is supported on the first support, and the second end is supported on the second support. The entire length between the first and second ends is self-supported. The entire self-supported length is configured to support and transfer weight of the load to the first and second ends supported on the first and second supports.

The at least two beams can comprise first and second beams. The first beam can be disposed at the first end of the longitudinal girder and can have a first distal end and a first proximal end. The first distal end can be supported on the first support, and the first proximal end can have a first shoulder and a first hinge. The second beam can be disposed at the second end of the longitudinal girder and can have a second distal end and a second proximal end. The second distal end can be supported on the second support, and the second proximal end can have a second shoulder and a second hinge.

The first hinge can comprises: a plurality of sets of adjacent joints; and one or more pins configured to pass through one or more of the sets of the adjacent joints. In a comparable manner, the second hinge can comprise a plurality of knuckles each configured to position between the adjacent joints of one of the one or more sets and each configured to have the pin pass therethrough.

The at least two beams can comprise one or more intermediate beams, each having first and second opposing ends. The first opposing end can have a third shoulder and a third hinge, and the second opposing end can have a fourth shoulder and a fourth hinge. The third hinge can be configured to hingedly connect to the first hinge of the first beam of the first beam or to the fourth hinge of another one of the one or more intermediate beams, and the third shoulder can be configured to abut the first shoulder of the first beam or of the fourth shoulder of the other intermediate beams. The fourth hinge and the fourth shoulder can be similarly configured for the second beam or another intermediate beam.

The at least two beams can each comprise: upper portions of opposing ends of the at least two beams shouldered together; and hinges on lower portions of the opposing ends of the at least two modular beams connect together.

The one or more longitudinal girders can comprise a plurality of the one or more longitudinal girders disposed parallel to one another. The longitudinal girders can be arranged with longitudinal sides disposed together. Alternatively, the longitudinal girders can be arranged with a space disposed between longitudinal sides, in which case the assembly can further comprise a plurality of inserts supported in the space between the longitudinal sides. For example, the longitudinal girders can comprise shelves disposed along the longitudinal sides, and the inserts can comprise: crossbeams disposed between the shelves of the longitudinal girders, and panels supported on the crossbeams.

Overall, each of the at least two beams can comprise a plate box beam having a top plate, a bottom plate, two side plates, and two end plates affixed together. Moreover, each plate box beam can comprise one or more internal plates disposed internally therein between the top, bottom, and two side plates.

At least one of the ends of each of the at least two beams can comprise a mounting plate configured to affix to the mounting plate of an opposing one of the at least two beams.

According to the present disclosure, the assembly disclosed above is used in a system for transporting a load across an expanse between first and second locations. The first and second locations can be on land and/or water and can have a base surface of ground, waterbed, and/or vessel between them. The system comprises a plurality supports mounting on the base surface and disposed on first and second sides of the expanse between the first and second locations. The assembly extends across the expanse with the assembly being supported on a first of the supports adjacent the first side of the expanse and being supported on a second of the supports adjacent the second side of the expanse.

The system can further comprise a plurality of ramps mounting on adjacent ones of the supports and/or on at least one the supports and the base surface. The system further comprise at least one transporter on which the load is supported, the at least one transporter configured to roll along the assembly. One or more of the supports can comprise a headstock having piers embedded in the base surface.

According to the present disclosure, a method is disclosed of transporting a load across an expanse between first and second locations. The first and second locations can be on land and/or water and having a base surface of ground, waterbed, and/or vessel between them. The method comprises: mounting a first support on the base surface on a first side of the expanse, and mounting a second support on the base surface on a second side of the expanse. The method comprises extending one or more longitudinal girders parallel to one another across the expanse by: hingedly connecting at least two modular beams end-to-end for each of the one or more longitudinal girders; supporting a first end of the one or more longitudinal girders on the first support; supporting a second end of the one or more longitudinal girders on the second support; and transferring weight of the load to the first and second ends supported on the first and second supports by self-supporting an entire length of the one or more longitudinal girders between the first and second ends.

The method can comprise mounting at least one first ramp on the first side and extending from the first support; and mounting at least one second ramp on the second side and extending from the second support. Mounting the at least one first ramp can comprise mounting a plurality of ramp supports; and supporting a plurality of the at least one first ramp on at least one of the ramp supports and/or on the base surface.

Hingedly connecting the at least two modular beams end-to-end for each of the one or more longitudinal girders can comprise: fitting a plurality of knuckles on a first of the at least two modular beams between adjacent joints on a second of the at least two modular beams; and passing one or more pins through one or more sets of the adjacent joints and knuckles.

Hingedly connecting the at least two modular beams end-to-end for each of the one or more longitudinal girders can comprise shouldering top edges of opposing ends of the at least two modular beams together; and mating hinges on bottom edges of the opposing ends of the at least two modular beams together.

Mounting the first support on the base surface on the first side of the expanse can comprise supporting a plurality of base hinges on a platform of the base support; and wherein supporting the first end of the one or more longitudinal girders on the first support comprises mating a plurality of beam hinges with the base hinges.

The method can further comprise loading the load at the first location onto at least one transporter on which the load is supported; and rolling the at least one transporter along the one or more longitudinal girders toward the second location.

The expanse can have a levee adjacent a waterway. Accordingly, the method can comprise: transporting the load along the waterway on at least one barge to the first location on the first side of the levee; loading the load onto at least one transporter by unloading the load from the barge to the at least one transport; and moving the load over the levee by rolling the at least one transporter along the one or more longitudinal girders toward the second location.

The foregoing summary is not intended to summarize each potential embodiment or every aspect of the present disclosure.

DETAILED DESCRIPTION OF THE DISCLOSURE

To transport a heavy, over-sized load, various supports, ramps, and bridgeway structures are constructed as needed to connect one location to another. Preferably, the structures are modular and mobile to facilitate assembly and disassembly. Additionally, the structures preferably do not require significant alteration of the surrounding base surface, such as ground, waterbed, levee, etc.

Figure 1A:
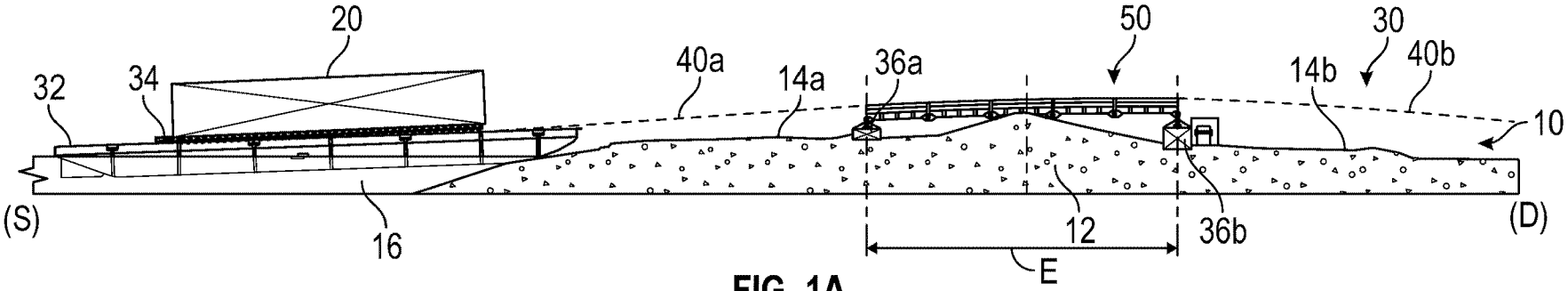
FIGS. 1A-1C illustrate elevational views of a modular system according to the present disclosure for transporting a heavy, over-sized load across an expanse between first and second locations.
Figure 1B:
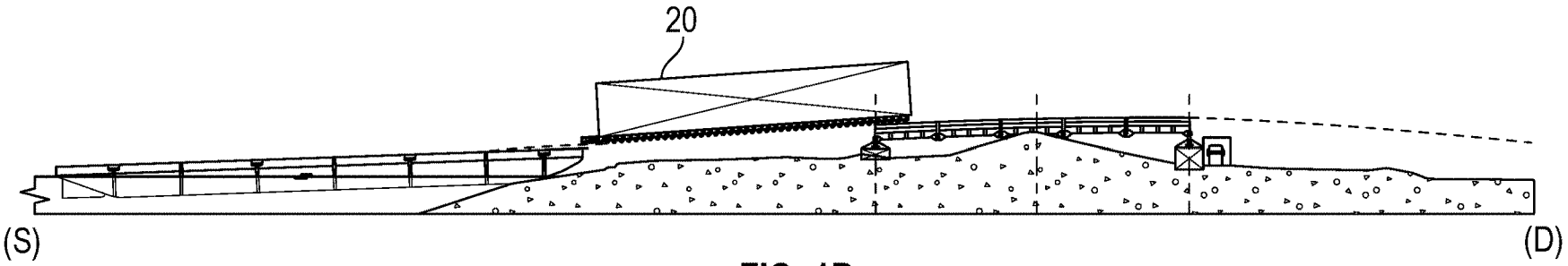
Figure 1C:
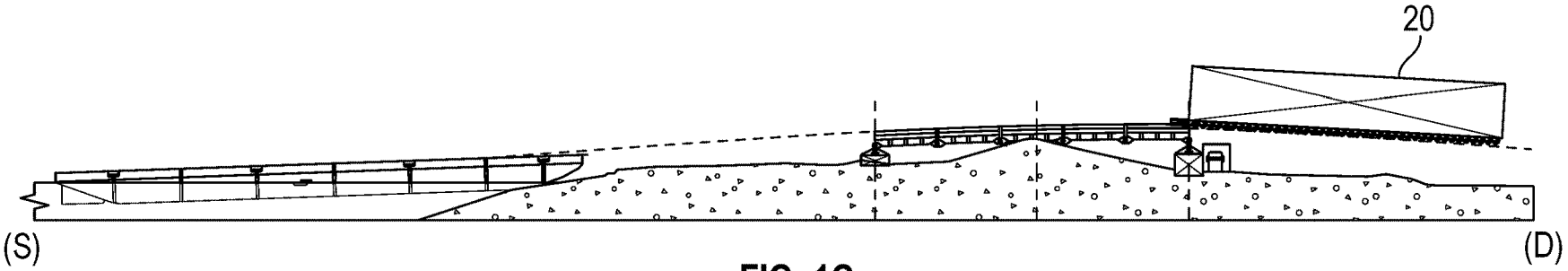

To that end, FIGS. 1A-1C illustrate elevational views of a modular system 30 according to the present disclosure for transporting a heavy, over-sized load 20 across an expanse (E) between first and second locations (i.e., start S and destination D). In general, the load 20 can have a high center-of-gravity and can be any heavy, over-sized load, including a large pipe rack module, a pressure vessel, an industrial unit, a refinery process, or the like. For example, the load 20 can be a unit that is transported to a refinery at the destination (D). As just an example, such a load 20 can be more than 50-ft wide and can weigh more than 1000 tons.

In general, the first and second locations S, D can be on land and/or water and can have a base surface of ground, waterbed, and/or vessel between them. As shown here, the start location S is a barge 32 on a waterway, and the destination location D is on land on the other side of the expanse (E) to be crossed.

In general, the expanse (E) can be any area, natural obstruction, man-made obstruction, or other obstacle for which application of the weight of the load 20 is to be avoided. In the present example, the expanse (E) includes a levee 12 that runs parallel to the waterway 16. Although the ground on either side 14*a-b* of the levee may support the weight of the load 20, the levee 12 itself preferably remains unmolested so as to not compromise its structure or integrity. As will be appreciated, any other feature either man-made or natural may benefit from the disclosed system 30 to avoid compromising or interfering with the feature.

The system 30 includes a barge 32, one or more transporters 34, supports 36*a-b*, ramps 40*a-b*, and a bridge 50, which are modular in construction. The over-sized, heavy load 20 is transported along the waterway 16 with the barge 32 while the one or more transporters 34 support the load 20 on the barge 32. Typically, such a load 20 is transported on multiple rows of transporters 34 connected side-by-side to create a wider loading platform ensuring stability of the load 20 during transport.

Such a transporter 34 can include a self-propelled modular transporter ("SPMT"), which is a combination of a trailer unit and a power pack unit. In general, the trailer unit includes longitudinal rows of paired wheels. Each axle of a given wheel pair can swivel independently of the other wheel pairs, and some or all of the wheels are individually controlled and hydraulically propelled. Each wheel assembly communicates with a controller that commands the wheel assembly to turn, brake, or rotate. Electronic control of the wheel assemblies allows for synchronous steering with unitary control of the wheel assemblies. The wheel assemblies can also be raised and lowered hydraulically to adjust the vertical height of the deck and can move up and down independently to allow movement over uneven surfaces without up and down movement of the upper load carrying deck. A particular example of such a transporter 34 is disclosed in U.S. Pat. No. 9,834,263 to Nooren, which is incorporated herein by reference.

As shown in FIG. 1A, the transporters 34 carry the load 20 from the barge 32 along a ramp 40*a* on a first side of the expanse (E). As then shown in FIGS. 1B-1C, the transporters 34 then carry the load 20 across the bridge 50 over the expanse (E) so the load 20 can be carried down another ramp 40*b* on the other side of the expanse (E). During the transport, the weight of the load 20 is not applied to the levee 12 or other feature in the expanse (E), which provides the benefits herein.

As noted above, components of the system 30 are modular, allowing for their assembly and eventual removal from the area without the need for significant engineering changes to the ground and any natural or man-made features. As will be discussed in more detail below, the supports 36*a-b*, the ramps 40*a-b*, and the bridge 50 are each modular in construction, allowing them to be installed for the particular needs, such as load capacity, width, distance, etc., of an implementation. Once the transport is complete, the modular construction of the supports 36*a-b*, the ramps 40*a-b*, and the bridge 50 allow for their disassembly for reuse in other transport operations.

Figure 2A:
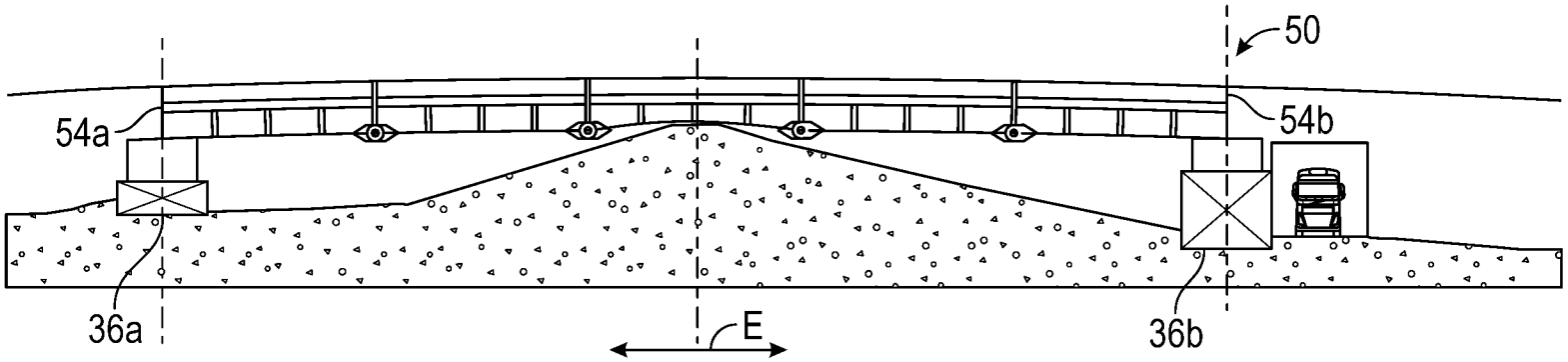
FIG. 2A illustrates an elevational view of a modular bridge of the disclosed system according to one embodiment.
Figure 2B:
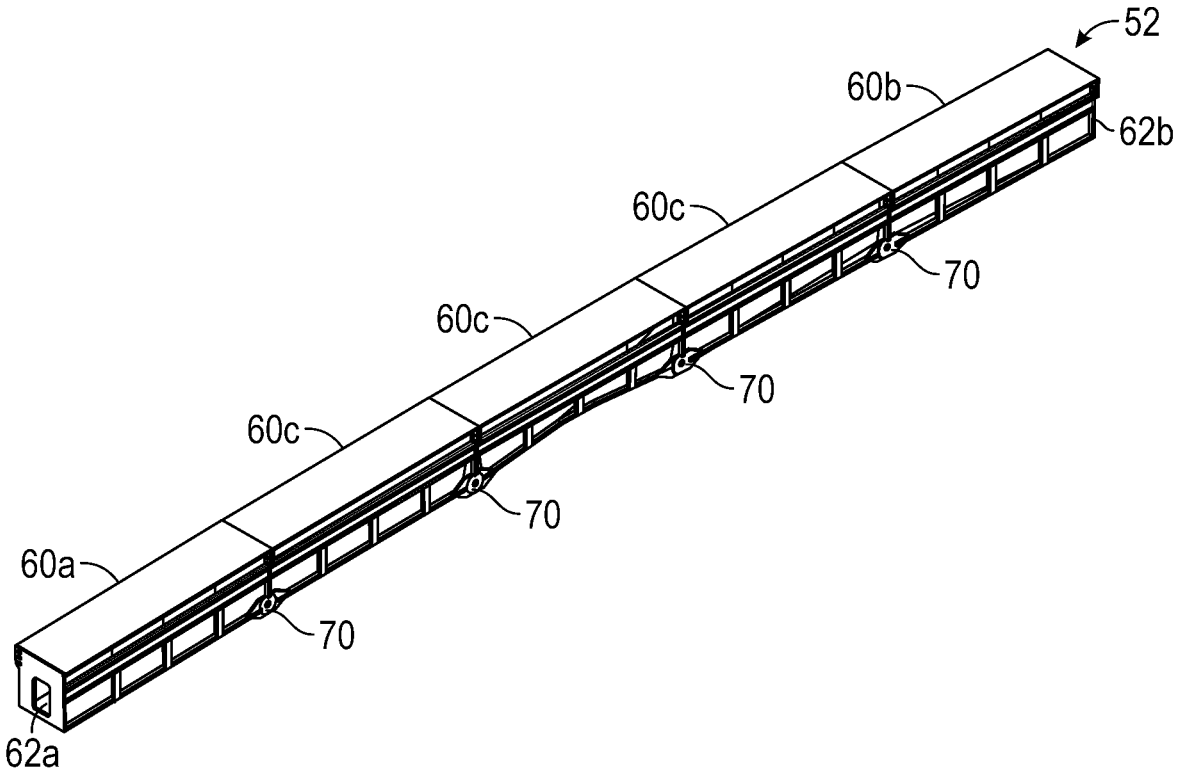
FIGS. 2B-2C illustrate perspective and end views of the modular bridge (or a portion thereof) in FIG. 2A.
Figure 2C:
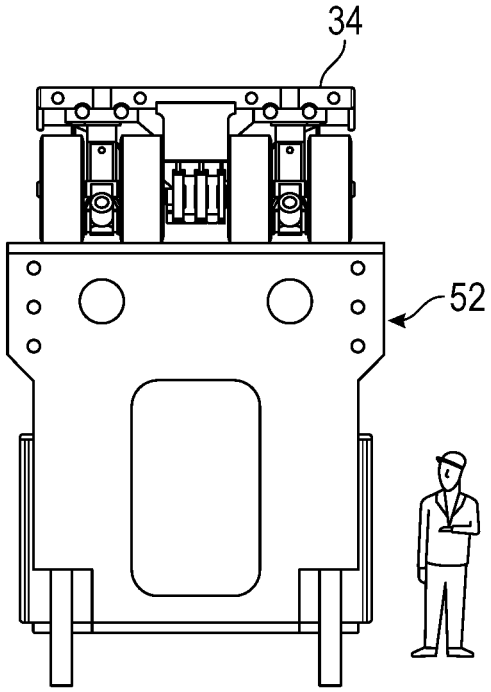

Looking at the components of the system 30 in more detail, FIG. 2A illustrates an elevational view of a modular bridge 50 of the disclosed system 30 according to one embodiment. FIGS. 2B-2C illustrate perspective and end views of the modular bridge (or a portion thereof) in FIG. 2A.

As shown, the modular bridge 50 includes at least one longitudinal girder 52 made up of a plurality of beams 60*a-c* hingedly connected together. One end 54*a* of the longitudinal girder 52 is supported on a first support 36*a* on one side of the expanse (E), and an opposite end 54*b* of the longitudinal girder 52 is supported on a second support 36*b* on the opposite side of the expanse (E).

As noted, the longitudinal girder 52 is made up of the beams 60*a-c* hingedly connected together. The beams 60*a-c* include first and second end beams 60*a-b*, and due the distance of the example, the girder 52 includes one or more intermediate beams 60*c*, each of which are hingedly connected together by hinged connections 70. In the example shown in FIG. 2B, the longitudinal girder 52 includes the first end beam 60*a*, three intermediate beams 60*c*, and the second end beam 60*c*. The modular nature of the beams 60*a-c*, however, allows for any suitable number of beams 60*a-c* to be used end-to-end to extend over an expanse. As will be appreciated, the number of beams 60*a-c* that can be used depends on suitable structural limits, the weight of the load 20 to be supported, the structural strength of the beams 60*a-c*, the length of each beam 60*a-c*, etc.

Although not shown, the longitudinal girder 52 could include the first and second end beams 60*a-b* hingedly connected together without any intermediate beam 60*c*. Moreover, the longitudinal girder 52 can include any number of the intermediate beams 60*c* interconnected between the first and second end beams 60*a-b*.

In general and as shown, the beams 60*a-c* are preferably longer than they are wide or high. Moreover, the beams 60*a-c* may preferably be higher than they are wide. Overall, the width of the beam 60*a-c* can be about or larger than the width of a modular transport 34. Some exemplary dimensions are discussed later.

Figure 3A:
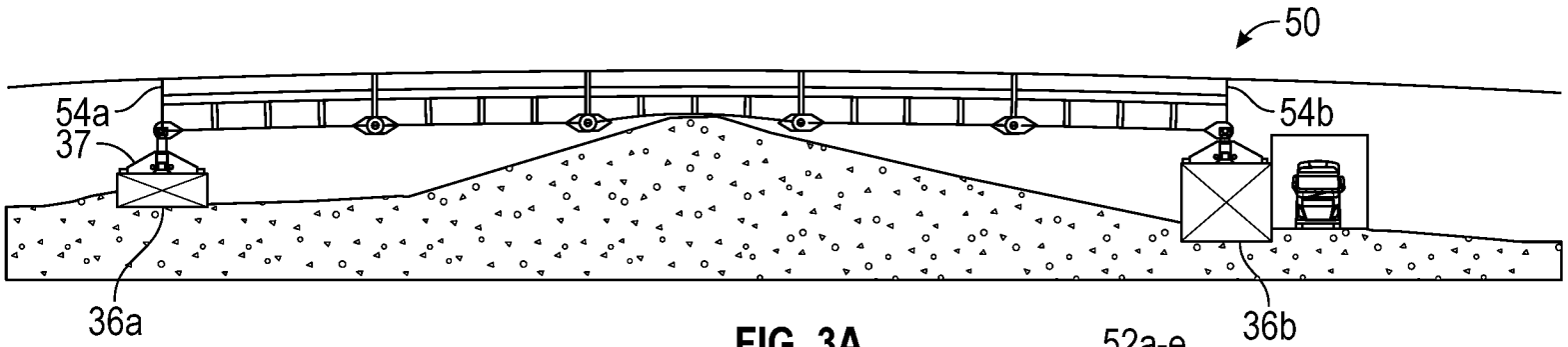
FIG. 3A illustrates an elevational view of a modular bridge of the disclosed system according to another embodiment.
Figure 3B:
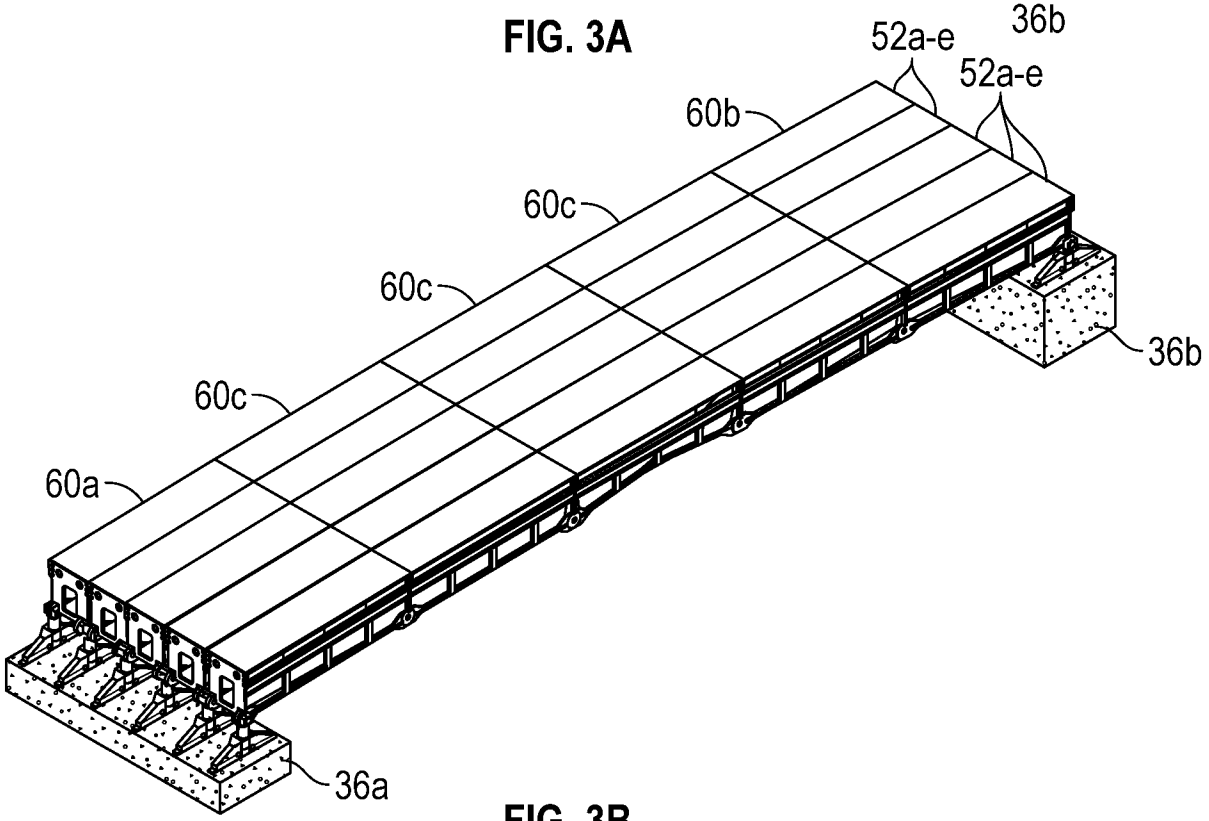
FIGS. 3B-3C illustrate perspective and end views of the modular bridge (or a portion thereof) in FIG. 3A.
Figure 3C:
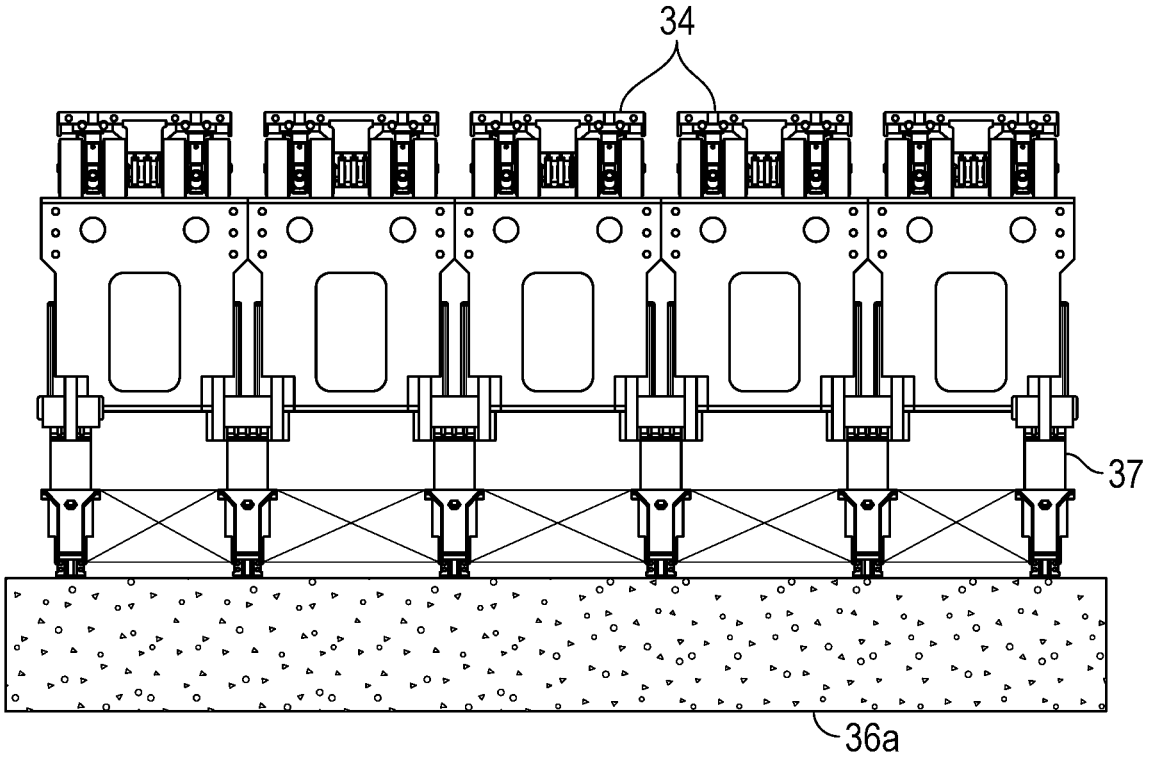

FIG. 3A illustrates an elevational view of a modular bridge 50 of the disclosed system according to another embodiment, and FIGS. 3B-3C illustrate perspective and end views of the modular bridge 50 (or a portion thereof) in FIG. 3A.

As shown, the modular bridge 50 includes a plurality of longitudinal girders 52*a-e* made up of a plurality of beams 60*a-c* hingedly connected together. First ends 54*a* of the longitudinal girders 52*a-e* are supported on a first support 36*a* on one side of the expanse (E), and opposite ends 54*b* of the longitudinal girders 52 are supported on a second support 36*b* on opposite side of the expanse (E).

The girders 52*a-e* are arranged parallel and side-by-side to one another to make up the bridge 50. As before, each of the longitudinal girders 52*a-e* is made up of the beams 60*a-c* hingedly connected together. The beams 60*a-c* include first and second end beams 60*a-b* and one or more intermediate beams 60*c*, each of which are hingedly connected together by hinged connections 70.

In the example shown in FIG. 3B, five of the longitudinal girders 52*a-e* run parallel to one another, and each includes the first end beam 60*a*, three intermediate beams 60*c*, and the second end beam 60*c*. Again, the modular nature of the girders 52*a-e* and the beams 60*a-c*, however, allows for any suitable number to be used side-by-side and end-to-end to extend over an expanse. As will be appreciated, the number that can be used depends on suitable structural limits, the weight of the load 20 to be supported, the structural strength of the beams 60*a-c*, the length of each beam 60*a-c*, etc.

The supports 36*a-b* can be pads disposed on the base surface or on earthen buildups, or the supports 36*a-b* can be stands with piers disposed in the base surface. As shown here, the supports 36*a-b* can include concrete pads having feet or stands 37 connected to the hinge connections 70 on the end beams 60*a-b*. Other arrangements for the supports can be used, as will be discussed below.

As noted above, an embodiment of the disclosed bridge 50 can have a number of longitudinal girders 52*a-e* running side-by-side without a space between them. In other embodiments, the disclosed bridge 50 can have a number of longitudinal girders 52 running parallel to another with slats, panels, or inserts placed in the spaces between the girders 52.

Figure 4A:
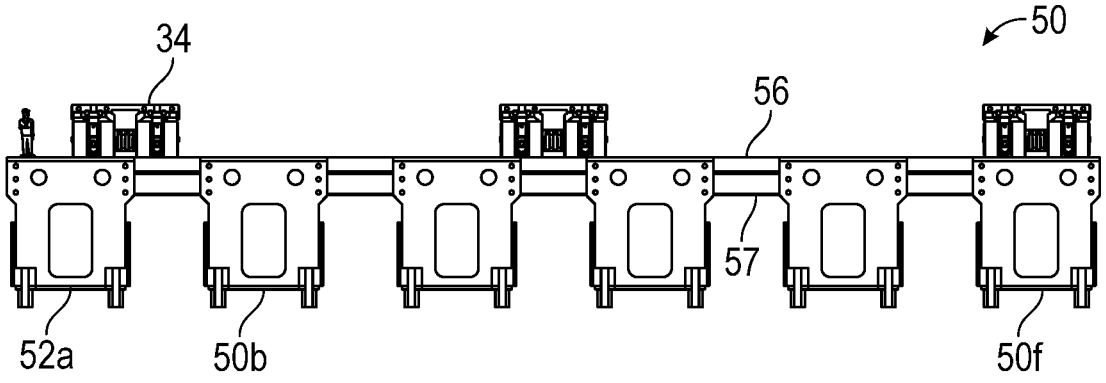
FIGS. 4A-4D illustrate end, side, upper perspective, and lower perspective views of a section of another modular bridge of the disclosed system.

For example, FIG. 4A illustrates an end view of a modular bridge 50 having a plurality of longitudinal girders 52*a-f* running parallel to another with slats, panels, or inserts 56 placed in the spaces between the girders 52*a-f*, which increases the width of the modular bridge 50. In the present example, the bridge 50 has six girders 52*a-f* separated by five inserts 56.

Figure 4B:
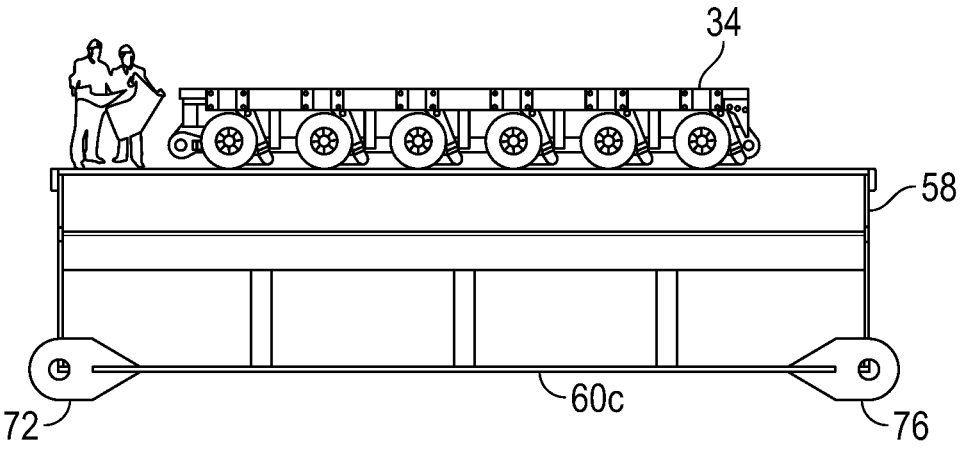
Figure 4C:
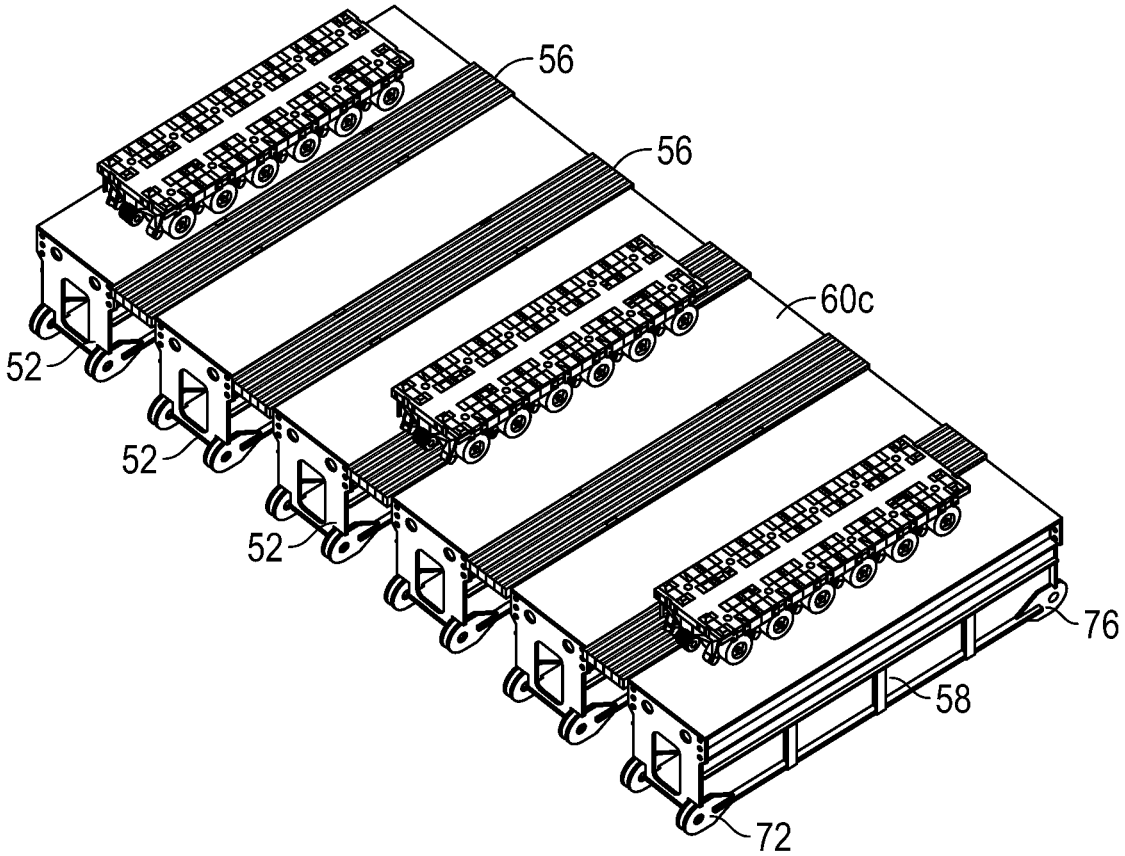
Figure 4D:
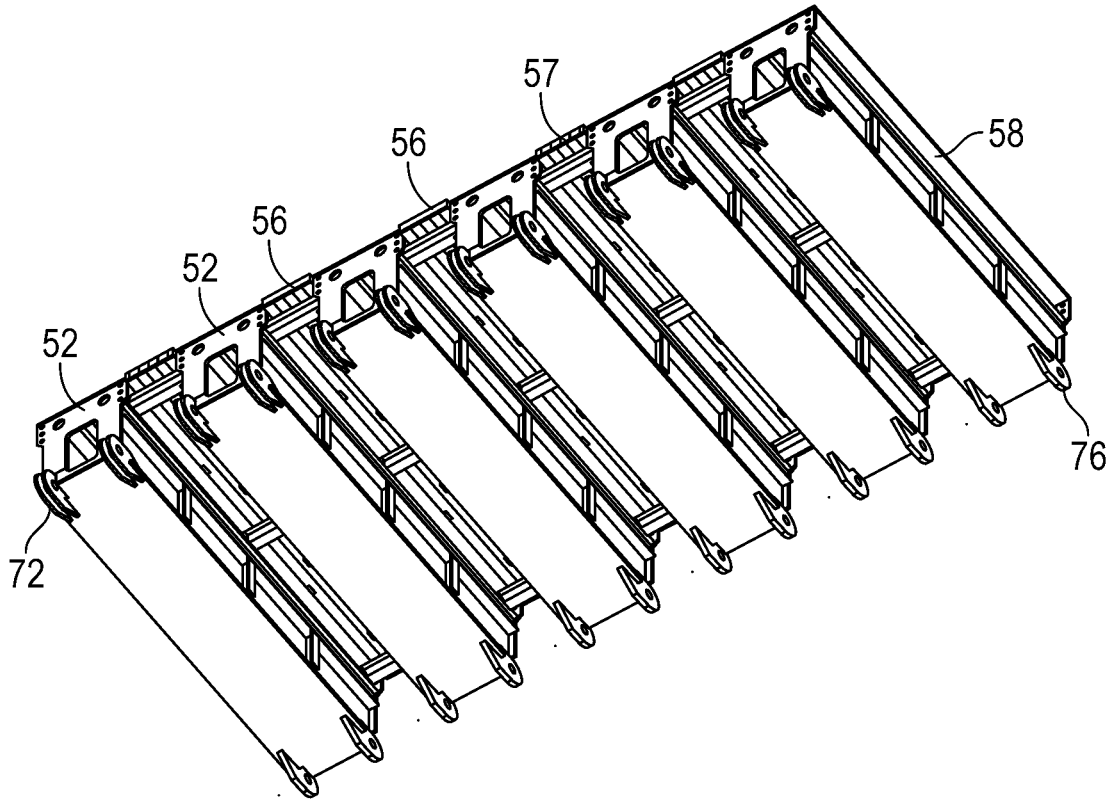

FIGS. 4B-4D illustrate side, upper perspective, and lower perspective views of a section of this modular bridge 50 of the disclosed system. In these figures, only one section of intermediate beams 60*c* for the bridge 50 is shown. As will be appreciated, the bridge 50 would be constructed of several end and intermediate beam sections connected end-to-end. FIGS. 4A and 4C show three transports 34 spaced out over the width of the bridge 50.

As best shown in FIGS. 4B-4D, the intermediate beams 60*c* include female members 72 and male members 76 of the pivot connections (70) for mating with compatible members of other beams, such as end beam (60*a-b*) or another intermediate beam 60*c*. As will be appreciated, the end beams (60*a-b*) for this bridge 50 would include suitable female members 72 and male members 76 of the pivot connections (70).

As best shown in FIGS. 4B-4D, the intermediate beams 60*c* include shelves or shoulders 58 along their longitudinal sides. The inserts 56 fit into the space between the beams 60*c* and are supported underneath by a plurality of cross beams 57 supported on the shoulders 58 of the beams 60*c*. As will be appreciated, the end beams (60*a-b*) for the bridge 50 would also include shoulders 58 to support inserts 56 with crossbeams 57.

Figure 5A:
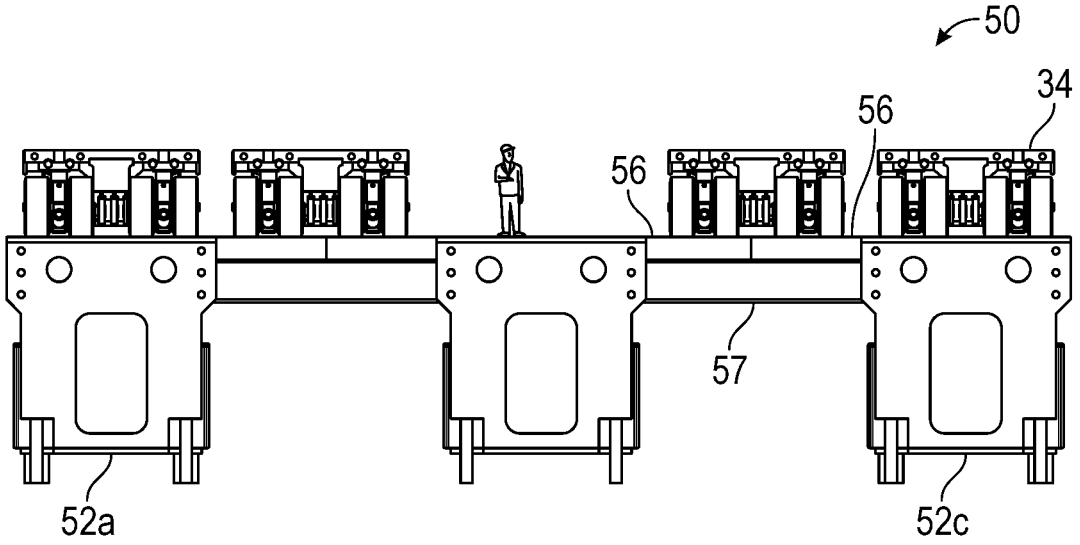
FIGS. 5A-5D illustrate end, side, upper perspective, and lower perspective views of a section of yet another modular bridge of the disclosed system.

In another example, FIG. 5A illustrates an end view of a modular bridge 50 having a plurality of longitudinal girders 52*a-c* running parallel to one another with slats, panels, or inserts 56 placed in the spaces between the girders 52*a-c*. In the present example, the bridge 50 has three girders 52*a-c* separated by two inserts 56.

Figure 5B:
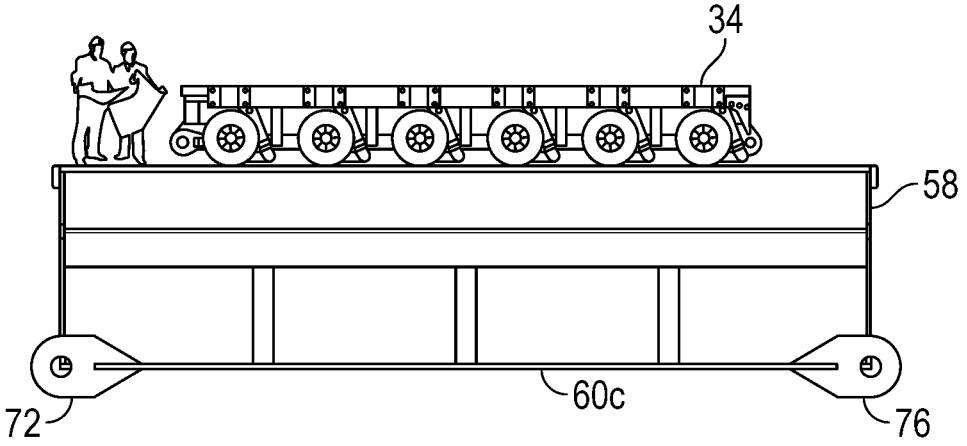
Figure 5C:
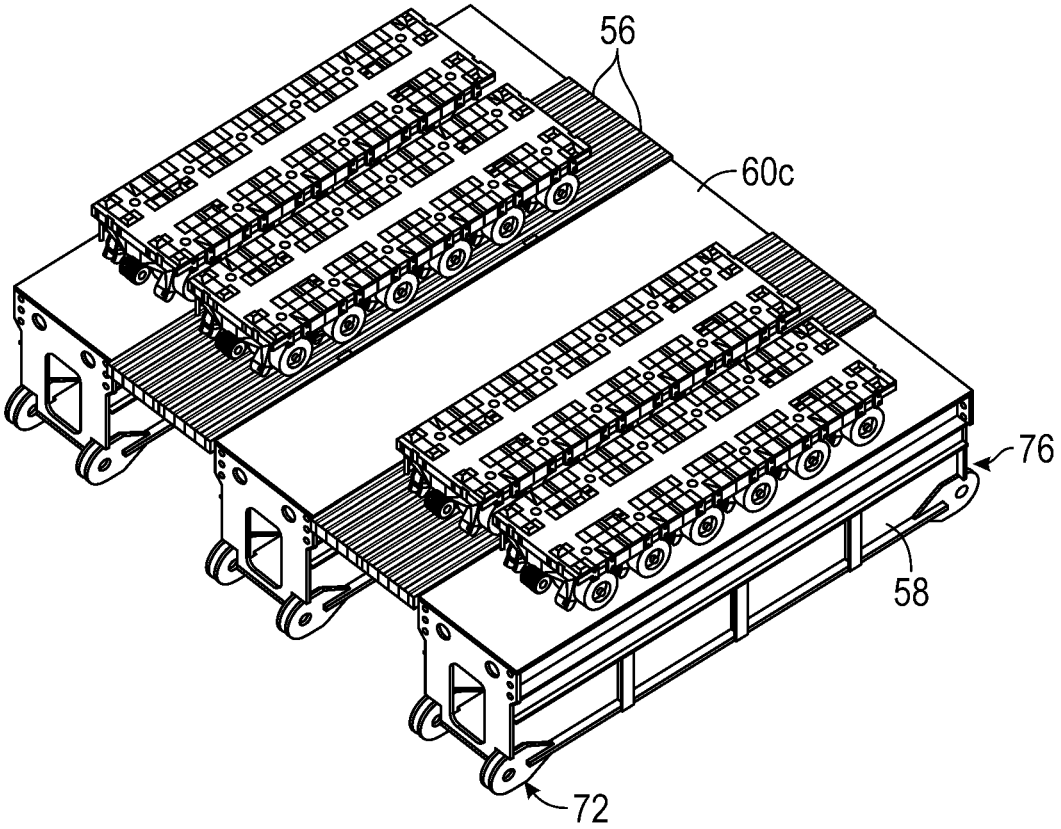
Figure 5D:
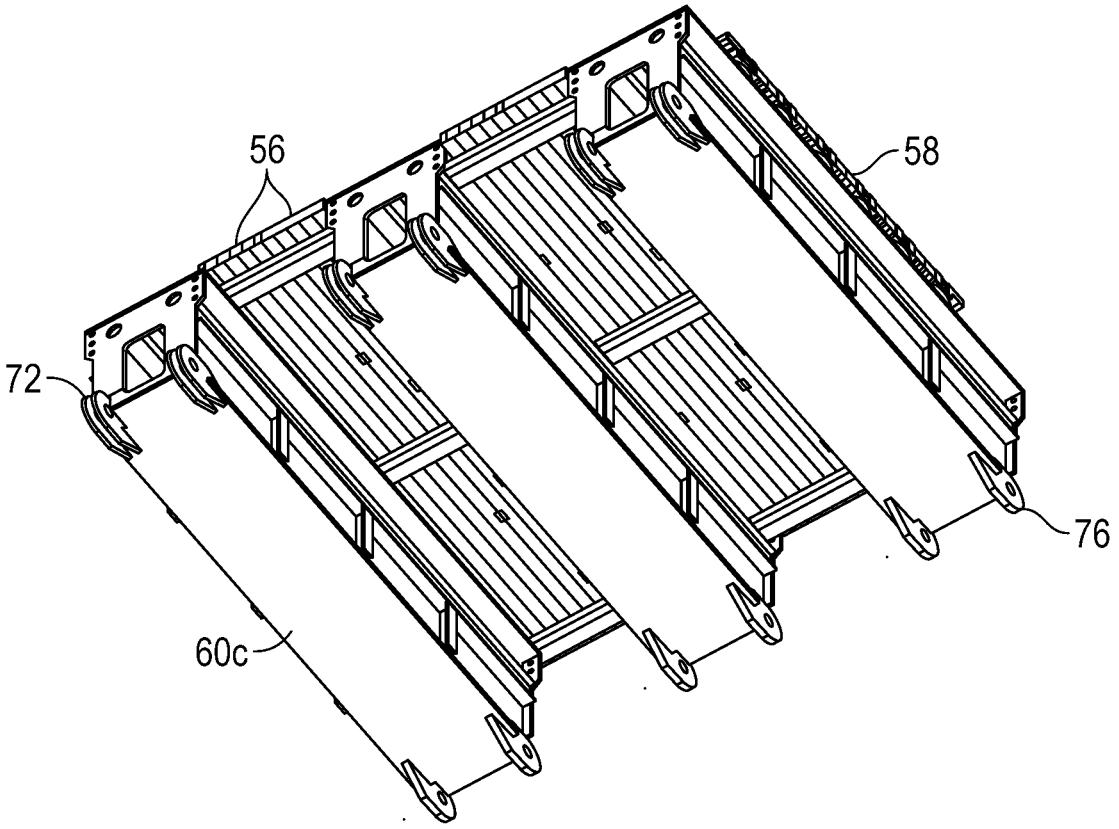

FIGS. 5B-5D illustrate side, upper perspective, and lower perspective views of a section of this modular bridge 50 of the disclosed system. In these figures, only one section of intermediate beams 60*c* for the bridge 50 is shown. As will be appreciated, the bridge 50 would be constructed of several such end and intermediate beam sections connected end-to-end. FIGS. 5A and 5C show four transports 34 spaced out over the width of the bridge 50.

Again and as best shown in FIGS. 5B-5D, the intermediate beams 60*c* include female members 72 and male members 76 of the pivot connections (70) for mating with compatible members of other beams, such as end beam (60*a-b*) or another intermediate beam 60*c*. As will be appreciated, the end beams (60*a-b*) for this bridge 50 would include suitable female members 72 and male members 76 of the pivot connections (70).

Again and as best shown in FIGS. 5B-5D, the intermediate beams 60*c* include shelves or shoulders 58 along their long sides. In this configuration and in contrast to that of FIGS. 4B-4D, double inserts 56 (or one wider insert 56) fit into the space between the beams 60*c* and are supported underneath by a plurality of longer crossbeams 57 supported on the shoulders 58 of the beams 60*c*. As will be appreciated, the end beams (60*a-b*) for the bridge 50 would also include shoulders 58 to support inserts 56 with crossbeams 57.

In general, each of the beams 60*a-c* can have a length L of about 11 to 12-m, a height H of about 3-m, and a width W of about 2.9 to 3-m. Each of the beams 60*a-c* can weigh about 65 tons. The inserts 56 can have a width of about 1.5-m and can have a length matching that of the beams 60*a-c*. Other dimensions can be used depending on the implementation.

Having an understanding of the modular bridge 50 of the present disclosure, discussion turns to the various beams 60*a-c* used.

Figure 6B:
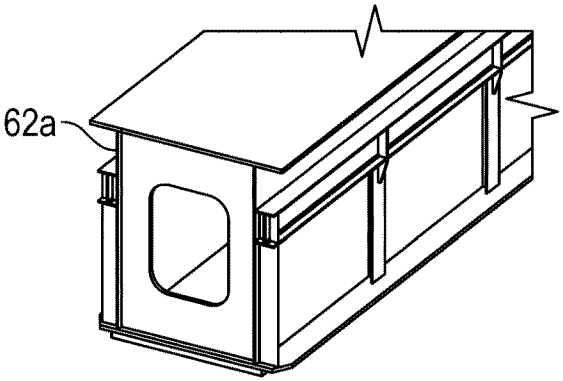
FIG. 6B illustrates a perspective view of another end of the first end beam for the disclosed modular bridge.
Figure 6C:
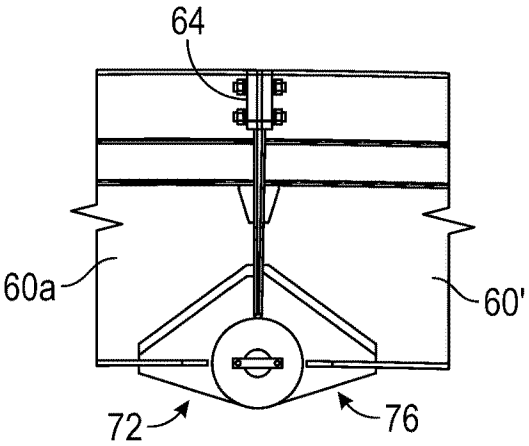
FIG. 6C illustrates connection of the first end beam hingedly connected to another beam of the modular bridge.
Figure 6A:
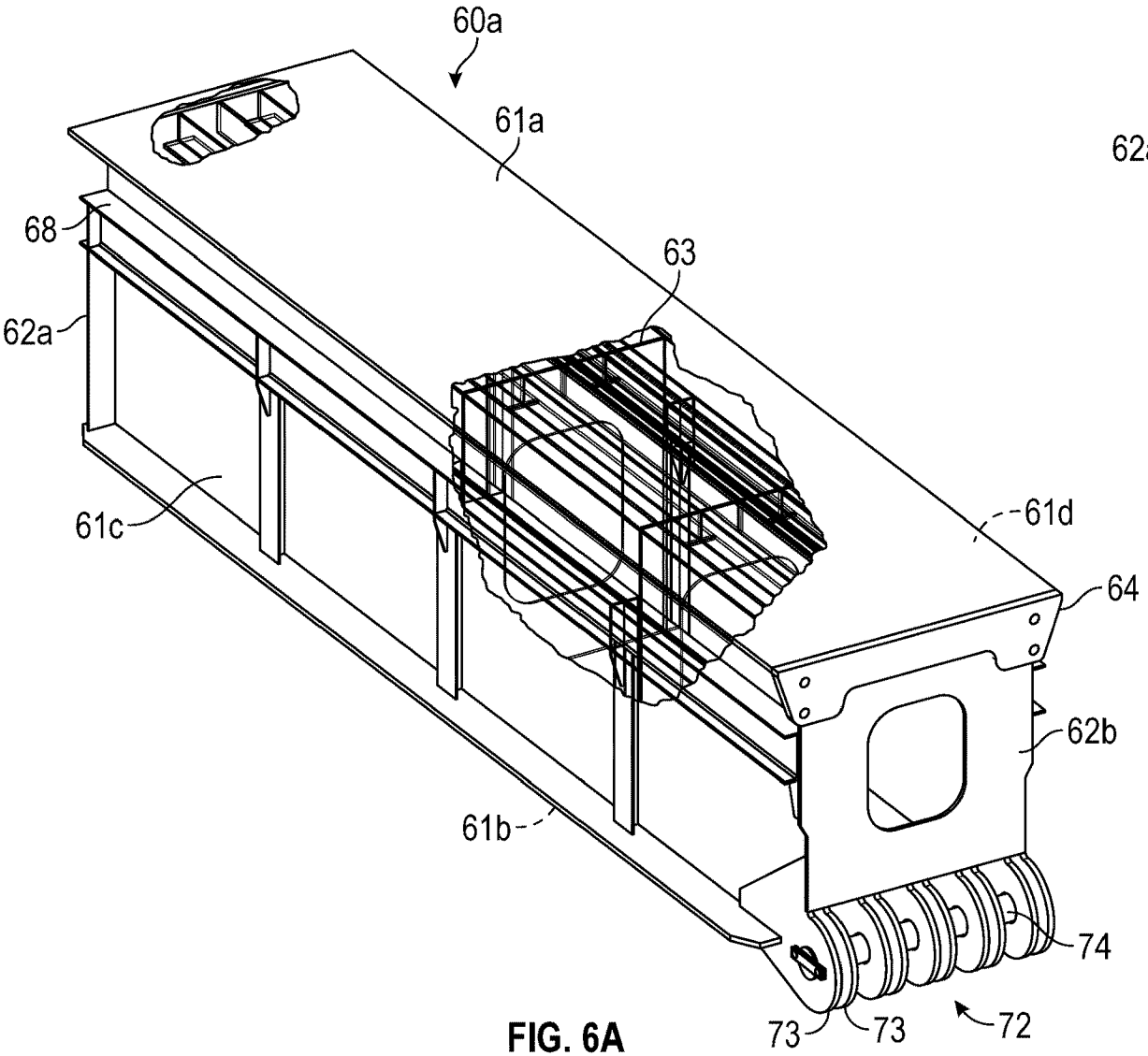
FIG. 6A illustrates a perspective view of one end of a first end beam for the disclosed modular bridge.

First, FIGS. 6A-6B show a first end beam 60*a* for the disclosed modular bridge. In particular, FIG. 6A illustrates a perspective view of a proximal end 62*b* of the first end beam 60*a*, and FIG. 6B illustrates a perspective view of a distal end 62*a* of the first end beam 60*a*.

The end beam 60*a* is a plate box beam having a top plate 61*a*, a bottom plate 61*b*, and two side plates 61*c-d* affixed (welded) together. Internally and at the ends 62*a-b*, the beam 60*a* includes transverse plates 63. When the end beam 60*a* is connected to other beams (60*b*, 60*c*), they form a plate box girder construction.

Various welds, fixtures, and the like can be used as needed. The sides plates 61*c-d* include the shelves or shoulders 68. The proximal end 62*b* as shown in FIG. 6A includes a fixture plate 64 for affixing (bolting) to another fixture plate of another beam. The distal end 62*a* as shown in FIG. 6B may not include such a fixture plate. The proximal end 62*b* as shown in FIG. 6A includes female hinge members 72 for mating with male hinge members (76) of another beam and for receiving one or more hinge pins 74. The distal end 62*a* as shown in FIG. 6B may not include such members for a hinge connection (70).

As shown in FIG. 6C, the proximal end 62*b* of the first end beam 60*a* connects with the hinged connection 70 to another beam 60', which can be an intermediate beam (60*c*) or second end beam (60*b*) for instance. The male members 76 of the other beam 60' mate with the female members 72 of the end beam 60*a*, and the one or more hinge pins 74 are inserted and held therein. The fixture plates 64 toward the top of the beams 60*a*, 60' are bolted together so that the proximal end 62*b* engages/shoulders against the opposing end of the other beam 60'. The mating between the ends of the beams 60*a*, 60' can be hard shimmed to give the two beams 60*a*, 60' a camber angle, which may be about 0.75 to 1.5 degrees. For example, shims (not shown) can be positioned along the top edges at the fixture plates 64 to set the camber angle between adjacent beams 60*a*, 60'.

The female hinge members 72 include a plurality of sets of adjacent joints or lugs 73 and one or more pins 74, which are configured to pass through one or more sets of the adjacent joints 73. For their part, the male hinge members 76 include a plurality of knuckles or lugs 77 each configured to position between the adjacent joints 73 of one of the sets of joints 73 and configured to have the pin 74 pass therethrough.

Figure 7B:
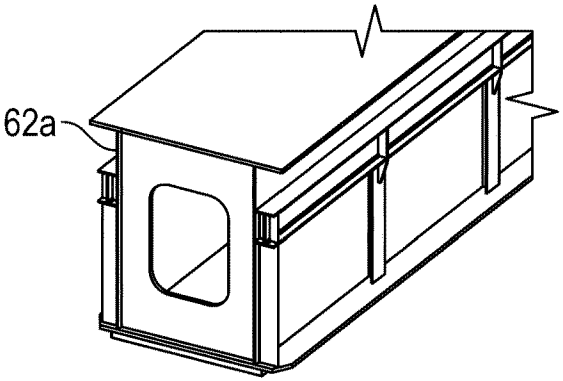
FIG. 7B illustrates a perspective view of another end of the second end beam for the disclosed modular bridge.
Figure 7C:
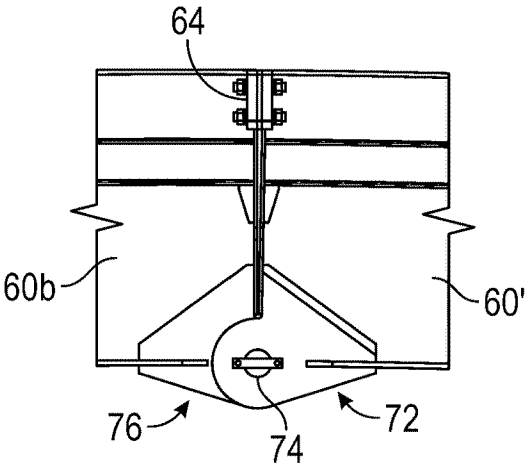
FIG. 7C illustrates connection of the second end beam hingedly connected to another beam of the modular bridge.
Figure 7A:
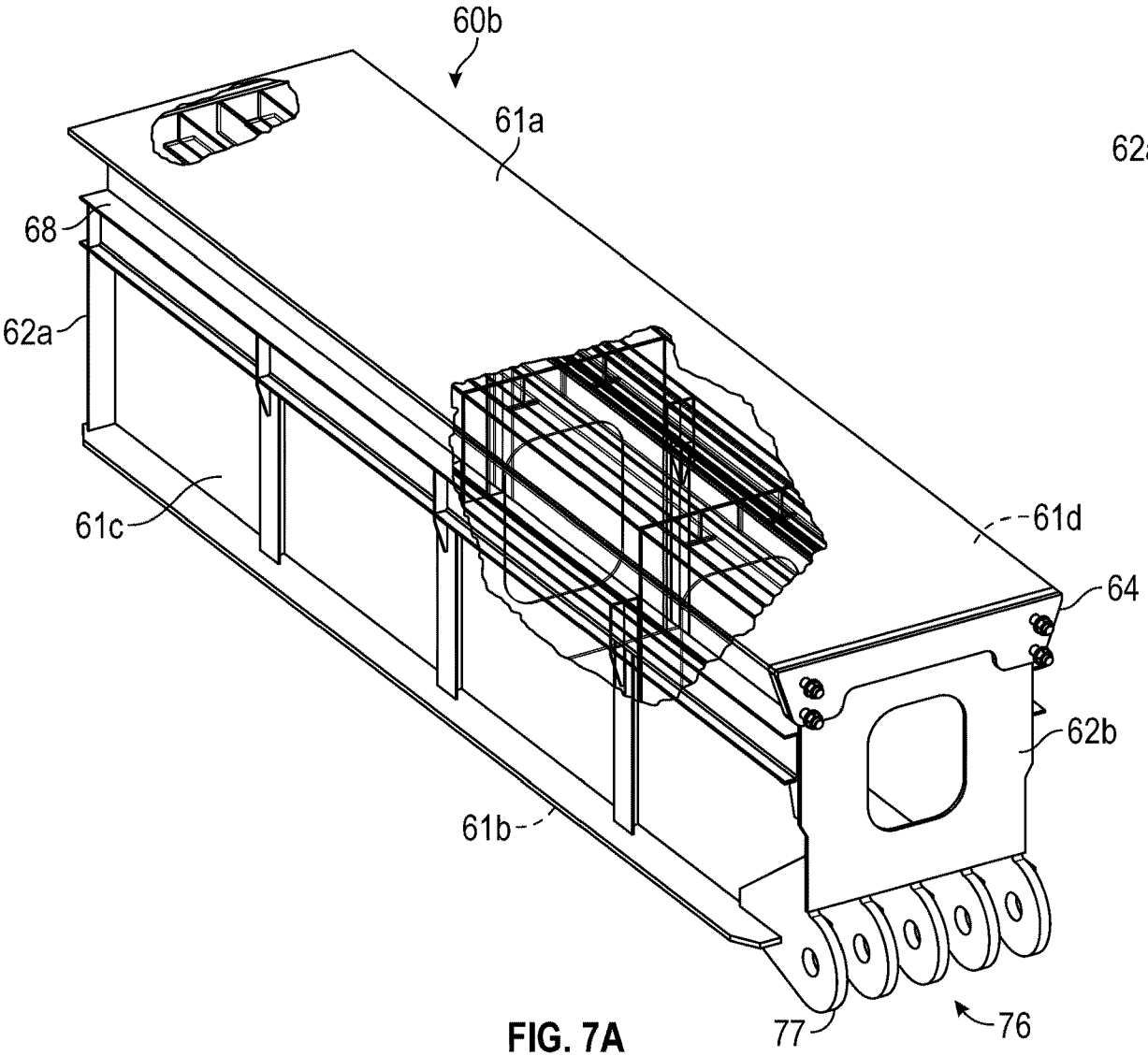
FIG. 7A illustrates a perspective view of one end of a second end beam for the disclosed modular bridge.

Next, FIGS. 7A-7B show a second end beam 60*b* for the disclosed modular bridge. In particular, FIG. 7A illustrates a perspective view of a proximal end 62*b* of the second end beam 60*b*, and FIG. 7B illustrates a perspective view of a distal end 62*a* of the second end beam 60*b*.

As before, the end beam 60*b* is a plate box beam having a top plate 61*a*, a bottom plate 61*b*, and two side plates 61*c-d* affixed (welded) together. Internally and at the ends 62*a-b*, the beam 60*b* includes transverse plates 63. When the end beam 60*b* is connected to other beams (60*a*, 60*c*), they form a plate box girder construction.

Various welds, fixtures, and the like can be used as needed. The sides plates 61*c-d* include the shelves or shoulders 68. The proximal end 62*b* as shown in FIG. 7A includes a fixture plate 64 for affixing (bolting) to another fixture plate of another beam. The distal end 62*a* as shown in FIG. 7B may not include such a fixture plate. The proximal end 62*b* as shown in FIG. 7A includes male hinge members 76 for mating with female hinge members (72) of another beam and for receiving one or more hinge pins 74. The distal end 62*a* as shown in FIG. 7B may not include such members for a hinge connection (70).

As shown in FIG. 7C, the proximal end 62*b* of the second end beam 60*b* connects with the hinged connection 70 to another beam 60', which can be an intermediate beam (60*c*) or first end beam (60*b*) for instance. The male members 72 of the beam 60*b* mate with the female members 76 of the other beam 60', and the one or more hinge pins 74 are inserted and held therein. The fixture plates 64 toward the top of the beams 60*b*, 60' are bolted together so that the proximal end 62*b* engages/shoulders against the opposing end of the other beam 60'. The mating between the ends of the beams 60*a*, 60' can be hard shimmed to give the two beams 60*a*, 60' a camber angle, which may be about 0.75 to 1.5 degrees.

Figure 8B:
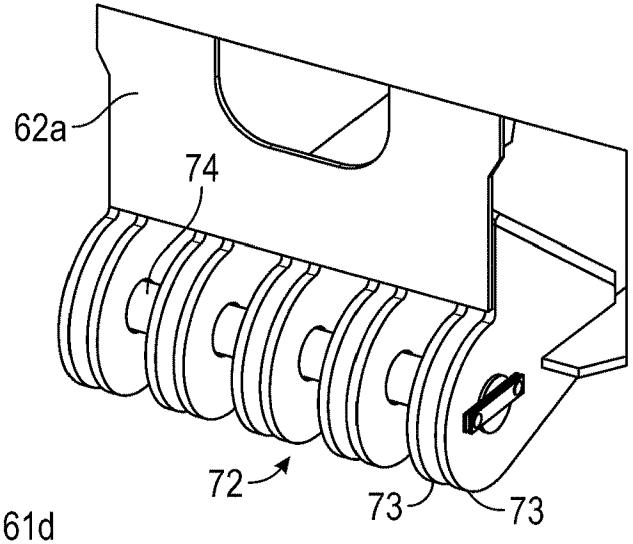
FIG. 8B illustrates a perspective view of another end of the intermediate beam for the disclosed modular bridge.
Figure 8C:
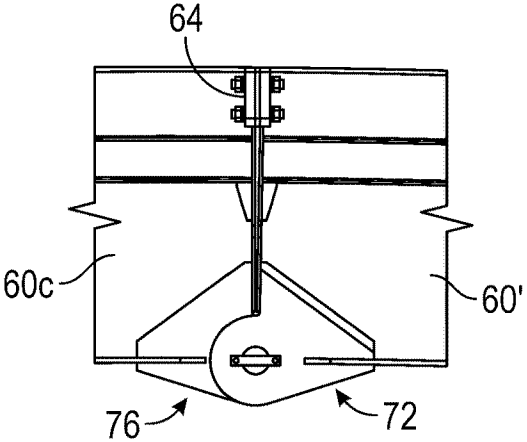
FIG. 8C illustrates connection of the intermediate beam hingedly connected to another beam of the modular bridge.
Figure 8A:
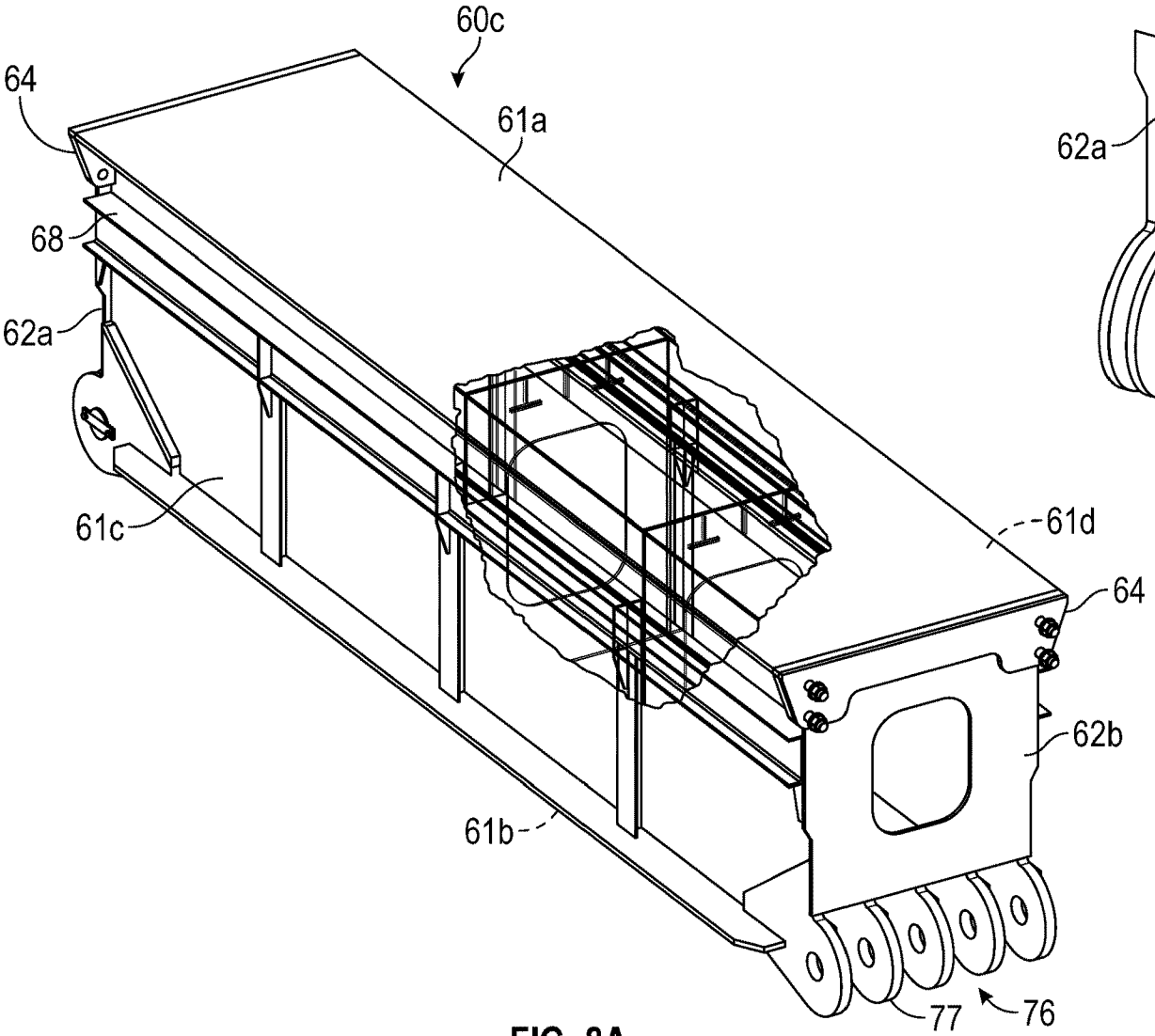
FIG. 8A illustrates a perspective view of one end of an intermediate beam for the disclosed modular bridge.

Finally, FIGS. 8A-8B show an intermediate beam 60*c* for the disclosed modular bridge. In particular, FIG. 8A illustrates a perspective view of a proximal end 62*b* of the intermediate beam 60*c*, and FIG. 8B illustrates a perspective view of a distal end 62*a* of the intermediate beam 60*c*.

As before, the intermediate beam 60*c* is a plate box-beam having a top plate 61*a*, a bottom plate 61*b*, and two side plates 61*c-d* affixed (welded) together. Internally and at the ends 62*a-b*, the beam 60*b* includes transverse rib plates 63. When the intermediate beam 60*c* is connected to other beams (60*a*, 60*b*, 60*c*), they form a plate box girder construction.

Various welds, fixtures, and the like can be used as needed. The sides plates 61*c-d* include the shelves or shoulders 68. The proximal end 62*b* as shown in FIG. 8A includes a fixture plate 64 for affixing (bolting) to another fixture plate of another beam. The distal end 62*a* as shown in FIG. 8A also includes such a fixture plate. The proximal end 62*b* as shown in FIG. 8A includes male hinge members 76 for mating with female hinge members (72) of another beam and for receiving one or more hinge pins 74. The distal end 62*a* as shown in FIG. 8B include female hinge members 72 for a hinge connection (70).

As shown in FIG. 8C, the proximal end 62*b* of the second end beam 60*b* connects with the hinged connection 70 to another beam 60', which can be an intermediate beam (60*c*) or second end beam (60*b*) for instance. The male members 72 of the beam 60*c* mate with the female members 72 of the other beam 60', and the one or more hinge pins 74 are inserted and held therein. The fixture plates 64 toward the top of the beams 60*c*, 60' are bolted together so that the proximal end 62*b* engages/shoulders against the opposing end of the other beam 60'. The mating between the ends of the beams 60*c*, 60' can be hard shimmed to give the two beams 60*a*, 60' a camber angle, which may be about 0.75 to 1.5 degrees.

Figure 9:
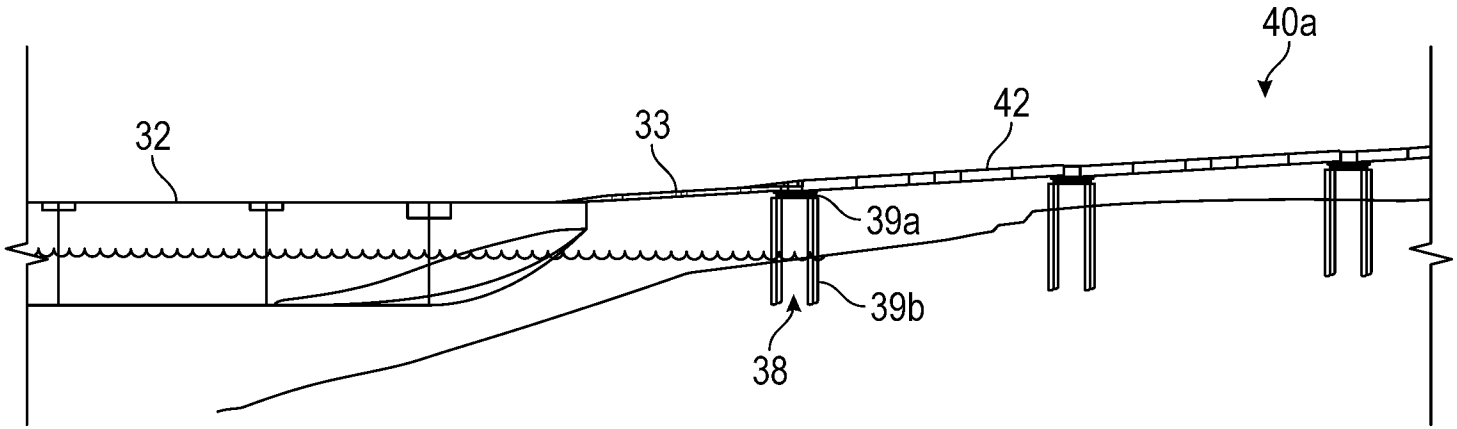
FIG. 9 illustrates an elevational view of a supports for the disclosed system.

As noted above, the disclosed system 30 includes ramps and stands for transporting the load. FIG. 9 illustrates an elevational view of the system 30, showing one type of supports 38 for supporting sections 42 of the ramps 40*a-b* of the disclosed system 30.

As shown in FIG. 9, for example, the support 38 can include a headstock 39*a* having piers 39*b* embedded in the ground. Ends of the ramp sections 42 can be supported on the headstocks 39*a* of the supports 38, which transfer loads from the ramp 40*a-b* to the piers 39*b*. Although not shown, additional features such as bearings and the like can be used. A modular ramp 33 is shown in FIG. 9 connecting the barge to a support 38 on the waterbed.

Figure 10A:
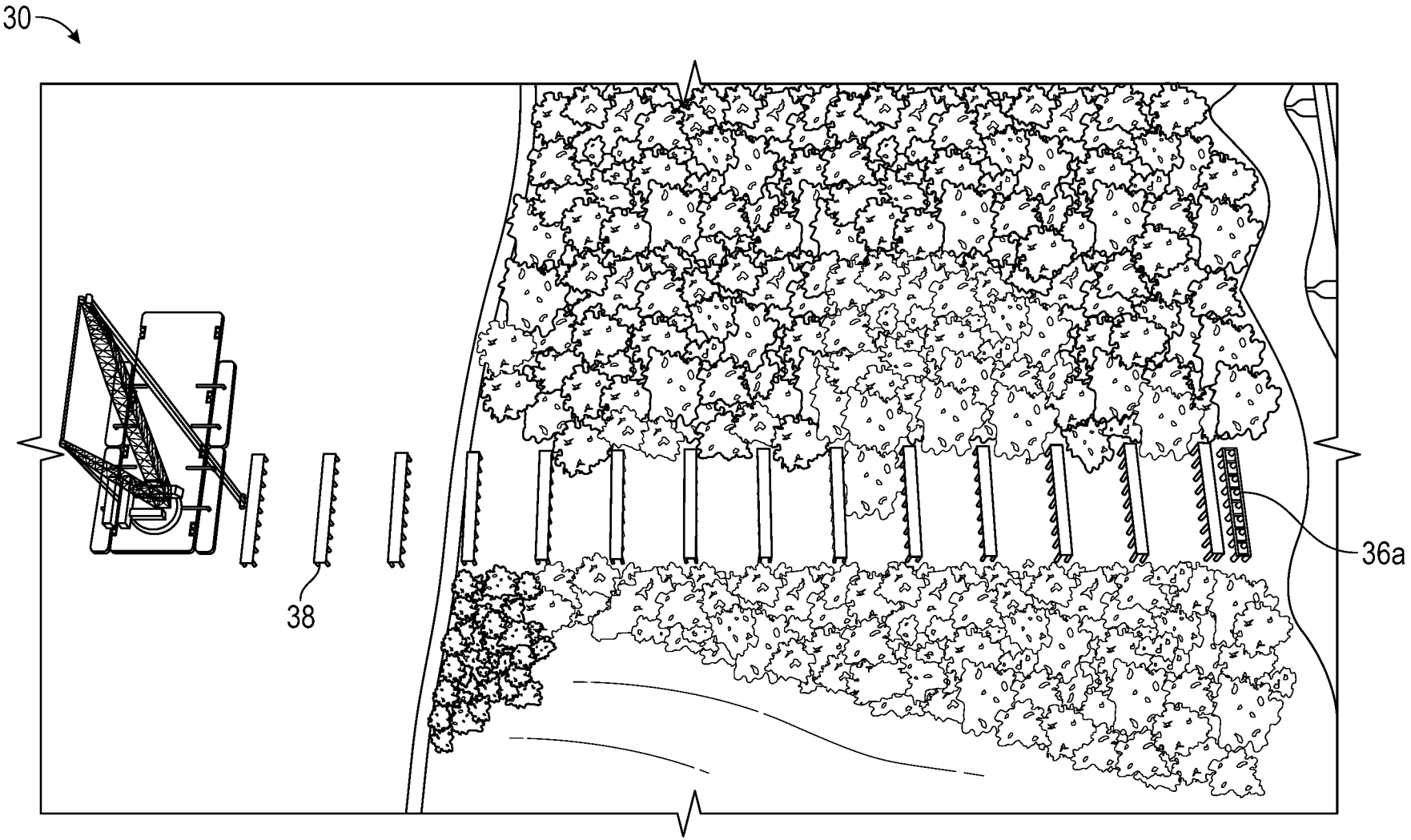
FIGS. 10A-10D illustrate the disclosed system during stages of assembly and use.

Finally, having an understanding of the system 30 and its components, FIGS. 10A-10D illustrate the disclosed system 30 during stages of assembly and use. First as shown in FIG. 10A, the supports 36*a*, 38 are installed on the base surface on one side of the expanse E, which can have a levee or the like. Here, ramp supports 38 are installed at suitable spacings on the ground and on the waterbed. An independent bridge support 36*a* may be installed on the side of the expanse E.

Figure 10B:
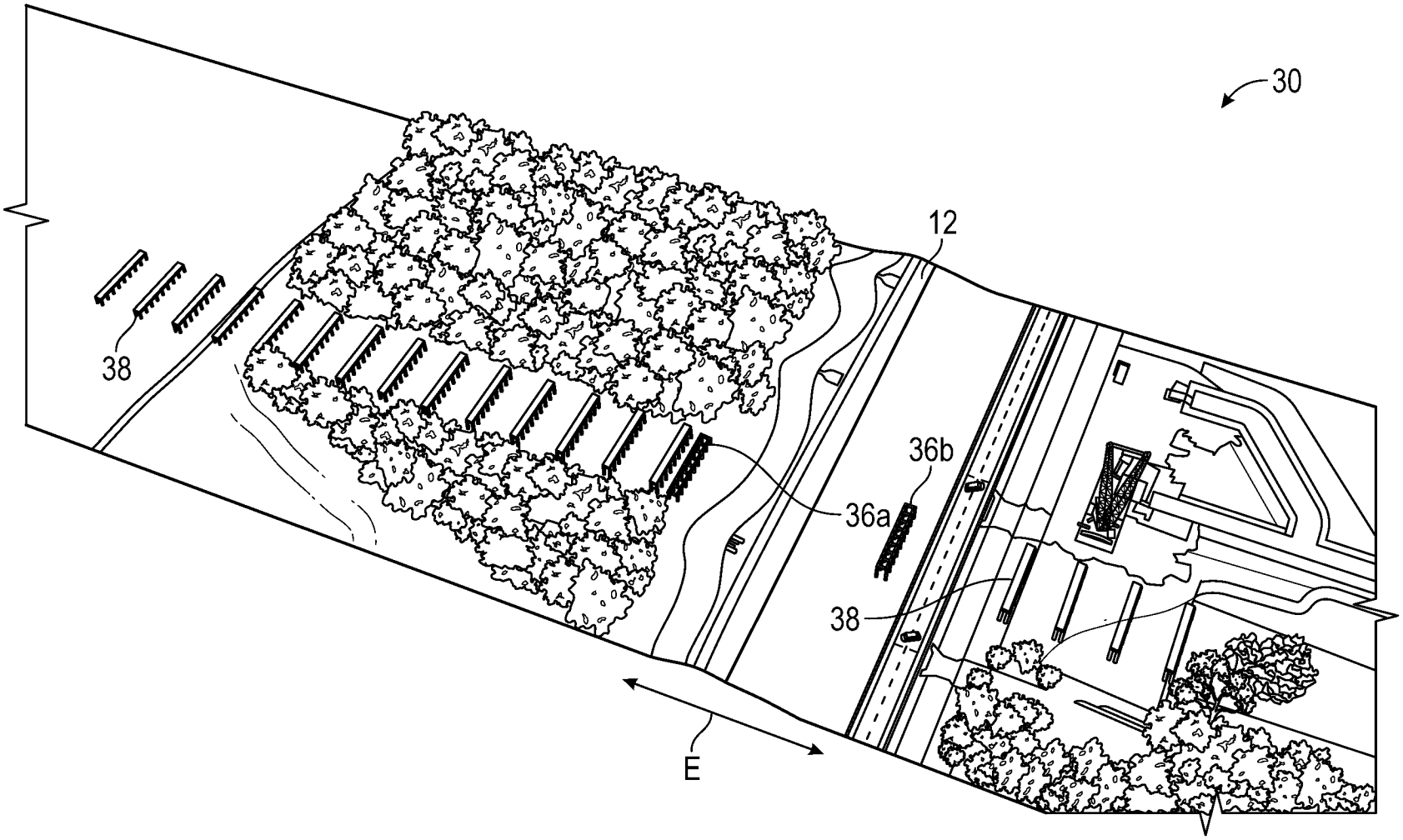

As shown in FIG. 10B, additional supports 36*a*, 38 are installed on the base surface on the other side of the expanse E having the levee 12. Here, ramp supports 38 are installed at suitable spacings on the ground to a destination D. An independent bridge support 36*b* may be installed on the side of the expanse E.

Figure 10C:
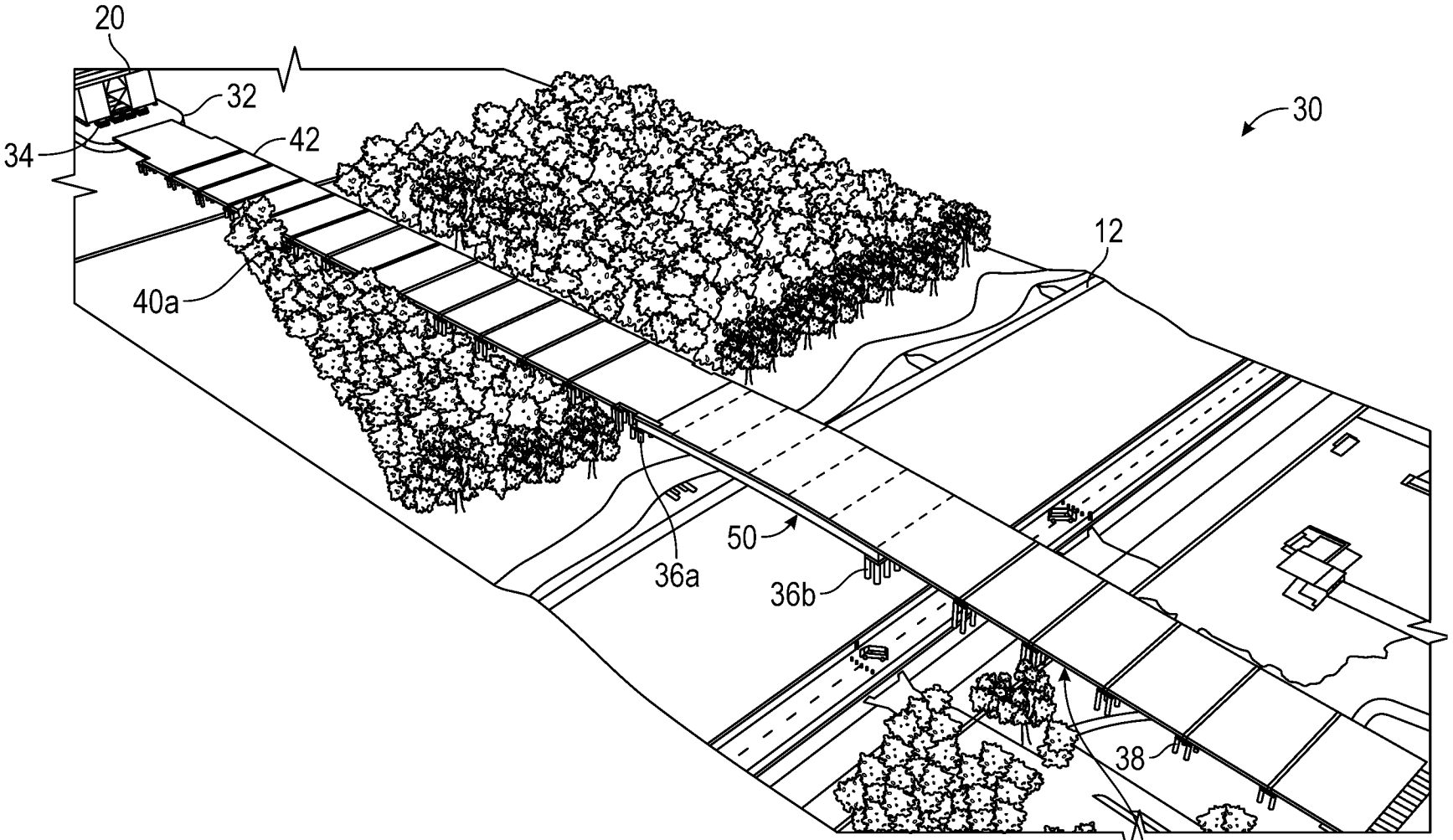

As shown in FIG. 10C, sections 42 of the ramps 40*a-b* are installed on the supports 38, and the bridge 50 is installed over the expanse (E) between the end supports 36*a-b*. Overall, the bridge 50 is assembled section-by-section from one end to the other. For each section, each individual beam 60*a-c* is placed side-by-side and temporarily supported, while being connected with the hinge connections. Inserts can be installed before the next section of beams 60*a-c* is constructed. As will be appreciated, various forms of necessary equipment and steps will be used for assembling the bridge 50 and are not shown or detailed here.

Figure 10D:
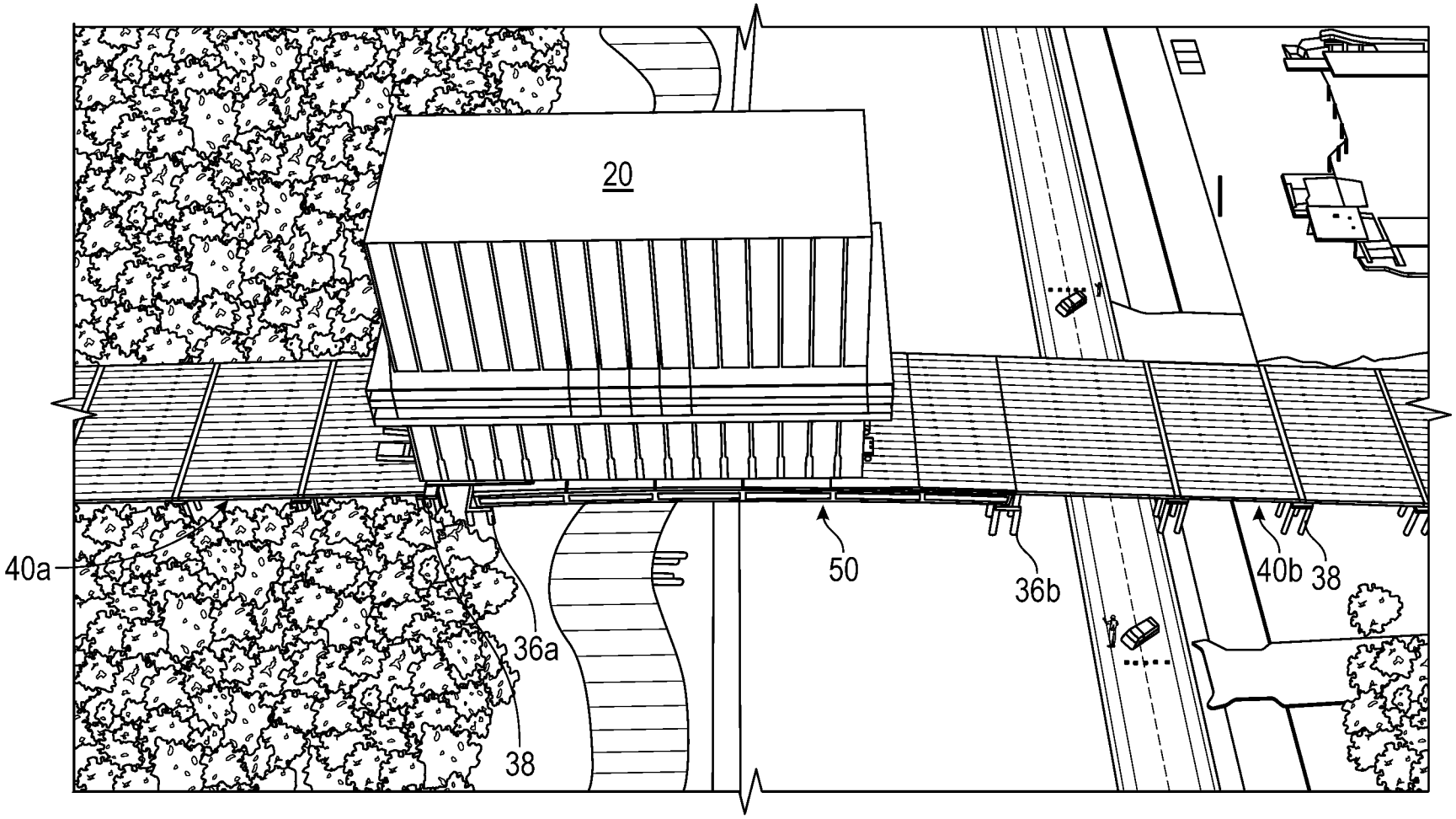

With the system 30 assembled, the load 20 as shown in FIG. 10C can be unloaded from the barge 32 using the transporters 34. Eventually as shown in FIG. 10D, the load 20 is transported along the ramp 40*a* and reaches the bridge 50, which supports the load 20 across the expanse (E) until the load 20 reaches the ramp 40*b* on the other side. Once transport is complete, the system 20 can be disassembled and used for another transport operation.

In general, the words "beam" and "girder" can be used interchangeably, and both beams and girders may perform the same or similar functions for the same or similar purposes. In general, a girder is used to refer to a long structural element. Merely for the sake of description, the present disclosure describes longitudinal girders that are comprised of several beams, which according to the present disclosure are connected end-to-end with hinged connections. Other descriptions could equally apply, however. For example, the present disclosure can describe longitudinal girders that are comprised of several segments or sections connected end-to-end with hinged connections, longitudinal beams that are comprised of several segments or sections connected end-to-end with hinged connections, etc.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desires all patent rights afforded by the appended embodiments. Therefore, it is intended that the appended embodiments include all modifications and alterations to the full extent that they come within the scope of the recited elements or the equivalents thereof.

What is claimed is:

1. An assembly for transporting a load across an expanse between first and second supports, the assembly comprising:

a plurality of longitudinal girders configured to extend parallel to one another across the expanse and arranged with a space disposed between longitudinal sides, the longitudinal girders comprising shelves disposed along the longitudinal sides; and a plurality of inserts supported in the space between the longitudinal sides, the inserts comprising: crossbeams disposed between the shelves of the longitudinal girders, and panels supported on the crossbeams, each of the longitudinal girders comprising at least two beams being modular and being hingedly connected end-to-end, each of the longitudinal girders comprising:

a first end supported on the first support, a second end supported on the second support, and an entire length between the first and second ends being self-supported, the entire self-supported length being configured to support and transfer weight of the load to the first and second ends supported on the first and second supports.

2. The assembly of claim 1, wherein the at least two beams comprise:

a first beam disposed at the first end of the longitudinal girder and having a first distal end and a first proximal end, the first distal end supported on the first support, the first proximal end having a first shoulder and a first hinge; and a second beam disposed at the second end of the longitudinal girder and having a second distal end and a second proximal end, the second distal end supported on the second support, the second proximal end having a second shoulder and a second hinge.

3. The assembly of claim 2, wherein the first hinge comprises:

a plurality of sets of adjacent joints; and one or more pins configured to pass through one or more of the sets of the adjacent joints.

4. The assembly of claim 3, wherein the second hinge comprises a plurality of knuckles each configured to position between the adjacent joints of one of the one or more sets and each configured to have the pin pass therethrough.

5. The assembly of claim 2, wherein the at least two beams comprise:

one or more intermediate beams, each having first and second opposing ends, the first opposing end having a third shoulder and a third hinge, the second opposing end having a fourth shoulder and a fourth hinge, the third hinge being configured to hingedly connect to the first hinge of the first beam or to the fourth hinge of another one of the one or more intermediate beams, the third shoulder being configured to abut the first shoulder of the first beam or to the fourth shoulder of the other intermediate beams, the fourth hinge being configured to hingedly connect to the second hinge of the second beam or to the third hinge of another one of the one or more intermediate beams, the fourth shoulder being configured to abut the second shoulder or the third shoulder of the other intermediate beam.

6. The assembly of claim 5, wherein the third hinge comprises:

a plurality of sets of adjacent joints; and one or more pins configured to pass through one or more of the sets of the adjacent joints.

7. The assembly of claim 6, wherein the fourth hinge comprises a plurality of knuckles each configured to position between the adjacent joints of one of the one or more sets and each configured to have the pin pass therethrough.

8. The assembly of claim 1, wherein the at least two beams each comprise:

upper portions of opposing ends of the at least two beams shouldered together; and hinges on lower portions of the opposing ends of the at least two modular beams connected together.

9. The assembly of claim 1, wherein each of the at least two beams comprises a plate box beam having a top plate, a bottom plate, two side plates, and two end plates affixed together.

10. The assembly of claim 9, wherein each plate box beam comprises one or more internal plates disposed internally therein between the top, bottom, and two side plates.

11. The assembly of claim 1, wherein at least one of the ends of each of the at least two beams comprises a mounting plate configured to affix to the mounting plate of an opposing one of the at least two beams.

12. The assembly of claim 1, wherein the panels of the inserts comprise first panels having a first width; and wherein the crossbeams comprise first crossbeams having a first length configured to the first width.

13. The assembly of claim 12, wherein the crossbeams comprise second crossbeams having a second length configured to at least twice the first width of the first panels; and wherein the first panels are supported in the space side-by-side between the longitudinal sides.

14. The assembly of claim 12, wherein the panels of the inserts further comprise second panels having a second width supported in the space between the longitudinal sides, the second width being greater than the first width of the first panels; and wherein the crossbeams comprise second crossbeams having a second length configured to the second width.

15. The assembly of claim 1, wherein each of the beams comprise a first length; and wherein the panels of the inserts comprise a second length matching the first length.

16. The assembly of claim 1, wherein each of the longitudinal girders comprises a lateral width configured to accommodate a width of a self-propelled modular transporter.

17. A system for transporting a load across an expanse between first and second locations, the first and second locations being on land and/or water and having a base surface of ground, waterbed, and/or vessel between them, the system comprising:

a plurality supports mounting on the base surface and disposed on first and second sides of the expanse between the first and second locations; and an assembly according to claim 1 extending across the expanse, the assembly being supported on a first of the supports adjacent the first side of the expanse and being supported on a second of the supports adjacent the second side of the expanse.

18. The system of claim 17, further comprising a plurality of ramps mounting on adjacent ones of the supports and/or on at least one of the supports and the base surface.

19. The system of claim 17, further comprising at least one transporter on which the load is supported, the at least one transporter configured to roll along the assembly.

20. The system of claim 17, wherein one or more of the supports comprise a headstock having piers embedded in the base surface.

* * * * *